United States Patent [19]

Tokunaga et al.

[11] Patent Number: 4,674,860

[45] Date of Patent: Jun. 23, 1987

[54] IMAGE TRANSFER DEVICE

[75] Inventors: Hiroshi Tokunaga; Shinobu Soma; Naoki Aoki; Tatsufumi Kusuda, all of Hachioji, Japan

[73] Assignee: Konishiroku Photo Industry Co., Tokyo, Japan

[21] Appl. No.: 766,770

[22] Filed: Aug. 16, 1985

[30] Foreign Application Priority Data

| | | | |
|---|---|---|---|
| Aug. 21, 1984 | [JP] | Japan | 59-174581 |
| Aug. 21, 1984 | [JP] | Japan | 59-174585 |
| Aug. 21, 1984 | [JP] | Japan | 59-174587 |
| Aug. 21, 1984 | [JP] | Japan | 59-174590 |
| Aug. 21, 1984 | [JP] | Japan | 59-174591 |

[51] Int. Cl.[4] ..... G03G 15/16

[52] U.S. Cl. ..... 355/3 TR; 355/4

[58] Field of Search ..... 355/3 R, 3 TR, 3 TE, 355/4; 430/48

[56] References Cited

U.S. PATENT DOCUMENTS

| | | | |
|---|---|---|---|
| 3,729,311 | 4/1973 | Langdon . | |
| 3,837,741 | 9/1974 | Spencer | 355/3 TR |
| 3,847,478 | 11/1974 | Young | 355/3 TR |
| 3,879,121 | 4/1975 | Simpson | 355/3 TR |
| 3,924,943 | 12/1975 | Fletcher | 355/3 TR |
| 3,936,175 | 2/1976 | Jones | 355/3 TR |
| 4,063,808 | 12/1977 | Simpson | 355/3 TR |

FOREIGN PATENT DOCUMENTS 55-18653 2/1980 Japan .

*Primary Examiner*—R. L. Moses

*Attorney, Agent, or Firm*—Frishauf, Holtz, Goodman & Woodward

[57] ABSTRACT

An image transfer device which transfers a charged toner carried on an image carrier onto a copying material comprises a transfer drum having a conductive base and an insulating surface, the transfer drum being arranged opposite to the image carrier. An electrical charge is applied to the copying material in advance of the copying material arriving at the insulating surface of the transfer drum. An electrical charge is also provided on the surface of the transfer drum in advance of the copying material arriving at the insulating surface of the transfer drum for attracting the copying material to the surface of the transfer drum and to maintain the attraction by the charges during a copying operation. In place of providing a specified charge on the surface of the transfer drum, a bias voltage can be applied to the conductive base of the transfer drum to provide the attraction force for improving attraction of the copying material to the surface of the transfer drum and to maintain the attraction during a copying operation.

18 Claims, 29 Drawing Figures

IMAGE TRANSFER DEVICE

BACKGROUND OF THE INVENTION

The present invention relates to an image transfer device for transferring a toner image formed by the electrophotographic process, etc., onto a copying material such as a sheet of copying paper, and more particularly to an image transfer device suitable for reproducing a multicolor image by superposing different color toner images on a same sheet of copying material through a series of toner transfer operations.

Various methods and devices therefor have hitherto been proposed for the purpose of obtaining multicolor image copies, using the electrophotographic process. The most commonly used method for obtaining such multicolor image copies is such that on an image carrier is formed a first color separation latent image to be developed by a first corresponding color toner, and the toner image is then transferred onto a copying material such as a sheet of paper, and on this are superposed sequentially a plurality of different color toner images by repeating the same process for the second, third . . . transfers according to a necessary number of color separations. In the process of superposing sequentially different color images on a copying material, the perfect register of the copying material to the image carrier is very important, and if the register is inaccurate, a doubling trouble occurs, and as a result the thus produced image becomes useless.

As means for accurately regulating the location of a sheet of copying paper to the image carrier, a transfer device of the type of the following construction is mostly used: A transfer drum is arranged adjacently to and in contact with an image carrier, and the drum, which has a sheet of copying material fixed thereto, is rotated synchronously with the image carrier, the copying material keeping always a constant positional relation with the image carrier. The transfer drum usually has thereon a mechanical detention means (gripper) to automatically stop and fix thereto the leading end of a sheet of copying material that has been brought by feed rollers, etc.

In transferring the toner image on the image carrier onto a sheet of copying material, in order to move the toner onto the copying material, an electrostatic process for charging the copying material is required, and in addition, the image carrier itself has electric charge. For these and other reasons complex electrostatic attractions are produced to act upon the copying material. The copying material, also because it is subjected to the mechanical force from the image carrier or transfer drum, tends to slip out of place. For the above reasons, it is the status quo that the mechanical detention of the copying material is adopted as the most secure way to prevent the copying material from the slippage.

For example, U.S. Pat. No. 3,729,311 discloses a color copier comprising a copying material-holding drum which is in contact with an image carrier drum, the copying material-holding drum having a gripper for fixing a copying material thereto. Japanese Patent Publication Open to Public Inspection (hereinafter referred to as Japanese Patent O.P.I. Publication) No. 18653/1980 discloses a color copier comprising a support for a copying material, the support being comprised of an insulating surface-having mesh screen in contact with an image carrier. The instance in this publication describes that mechanical means for detaining a copying material is not necessarily required because the copying material is electrostatically attracted to the support therefor, but the screen-type support's contact area with the copying material is small, so that in order to insure the fixing and retention of the copying material, it is necessary to provide a detention means to the support.

However, in the case where a detention means is provided on the transfer drum, there arise many such problems that a complex mechanism is required for the automatic detention of a copying material, release of the detention and separation of the copying material; restrictions are put on the rate and sequence of the copying operation due to waiting for the detaining position; the detention section is soiled, and blank space is produced at the copying material's leading end detained by the detention section; the cleaning device for the copying material-holding drum requires a mechanism for eluding the gripper position; the gripper's soil by toner soils the copying material; and the like. Accordingly, the development of a more simplified and secure copying material-fixing means has been demanded.

It is therefore an object of the present invention to provide an image transfer device for multicolor electrostatic recording apparatus, the image transfer device being of a simple structure capable of securely transferring and superposing a plurality of different color toner images without doubling onto a copying material.

SUMMARY OF THE INVENTION

The above object of this invention is accomplished by an image carrier, an insulating surface-having image transfer drum provided opposite to and in contact with the image carrier, and a copying material-charge-providing means for in advance providing electric charge to a copying material.

DETAILED DESCRIPTION OF THE INVENTION

Figure 1:
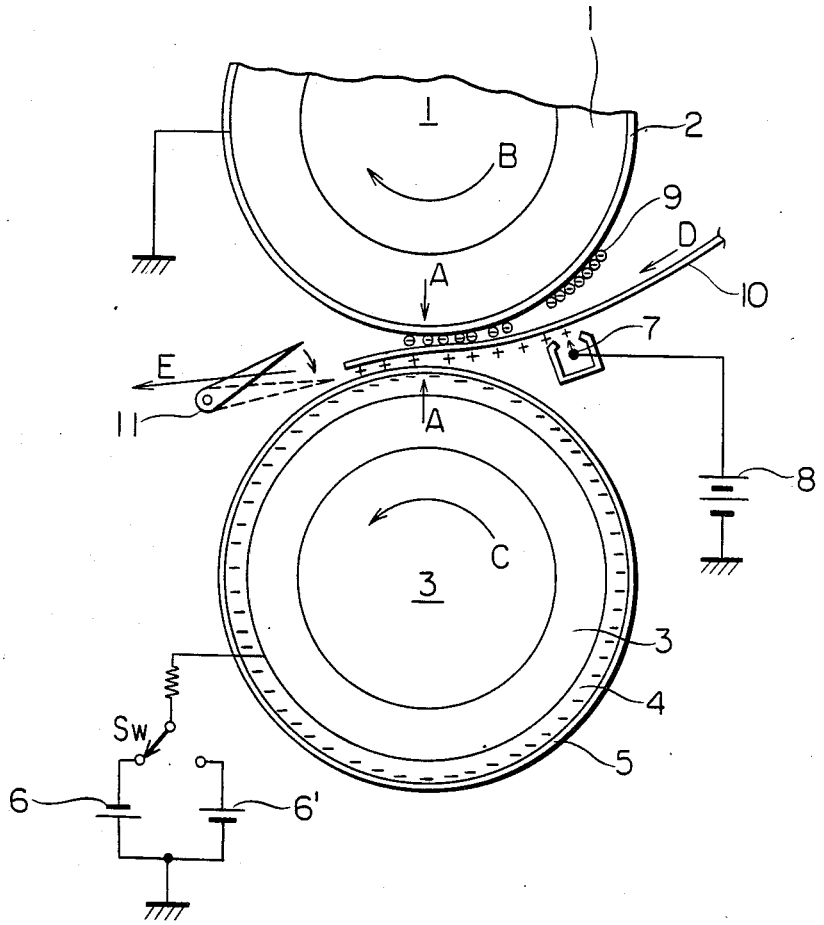
FIGS. 1, 5, 7, 10, 12, 17 and 19 each is a schematic drawing of the image transfer device of this invention.

In the device of this invention, to a copying material is in advance provided electric charge, prior to image transfer, by a copying material-charge-providing means, and is electrostatically attracted and fixed to the insulating surface of an image transfer drum, and therefore the device requires no detention means such as a gripper for fixing a copying material onto the image transfer drum. Accordingly, the device is able to perform superposed transfer of multicolor toner images free of a doubling trouble without causing the previously mentioned various problems.

The image transfer drum used for the device of this invention is desirable to have its surface provided with an appropriate elasticity because it needs to press a copying material against the surface of the image carrier. Accordingly, the image transfer drum is desirable to be of the construction comprising a conductive base having thereon a conductive elastic layer, on the surface of which is further provided an insulating layer.

The preferred material as the conductive base is a metal such as, for example, aluminum. The preferred materials usable as the conductive elastic layer include conductive rubbers such as, e.g., silicone-type or chloroprene-type conductive rubbers. These conductive elastic materials are desirable to have a rubber hardness of from 40° to 70° and a volume resistivity of not more than $10^8$ Ω.cm, and the thickness thereof to be formed on the conductive base is desirable to be from about 1 to about 10 mm.

The above-mentioned insulating layer may be constructed by using any of various insulating materials including, e.g., polyesters, polycarbonates, polyvinyl chloride, polyvinylidene chloride, polyvinyl acetate, methacrylic resin, acrylic resin, polystyrene, silicone resin, fluororesin, styrene-butadiene copolymer, and various other polymers or copolymeric high-molecular compounds, and rubber. Any of these insultaing materials may be coated on the surface of the conductive elastic layer or directly on the surface of the conductive base, or used in the form of heat-shrinkable tubing to shrinkingly cover the same to thereby form an insulating layer. The thickness of the insulating layer is preferably from 10 to 100 μm. If the thickness is less than the range, the layer becomes difficult of manufacture and the mechanical strength thereof becomes deteriorated, thus causing difficulty in making practical use of the layer, while if the thickness exceeds the range, it causes disadvantage in respect of the holding of a copying material, the toner transfer effeciency, and the like.

Although it is not necessary to particularly provide electric charge to the image transfer drum, in order to strengthen the electrostatic attraction of a copying material and to accelerate the transfer of toner onto a copying material, it is desirable to provide an appropriate electric potential to the drum. The provision of an electric potential is desirable to be made by applying a DC bias voltage to the conductive base of the image transfer drum or by using a charge-providing means such as a corona discharger to thereby provide electric charge to the insulating surface of the drum. In the case where no electric charge is particularly provided or where electric charge is provided to the surface of the drum by charge-providing means, the groundable base of the image transfer drum is desirable to be grounded.

The polarity of the electric potential to be applied to the image transfer drum may be determined to be either the same as or opposite polarity to that of the charge of the toner to be transferred according to the relation with the polarity of the electric charge provided to the copying material, and the polarity may also be made changeable in the course of the image transfer process.

The copying material-charge-providing means used in this invention is not restricted as long as it is capable of providing electric charge to a copying material, and a corona discharger is particularly suitably usable as the means. The polarity of the electric charge to be provided is set to be either the same as or opposite to that of the toner according to the electric charge of the toner (determined according to the polarity of the electrostatic image formed on the image carrier) and the electric potential of the image transfer drum. The appropriate voltage to be applied to the corona discharger, although different according to the nature of the toner used, is usually (+ or −) 5 to 8 KV. Electric charge may be provided to a copying material from either the obverse side or reverse side thereof.

As has been described above, in the image transfer device of this invention, various combinations can be established between the polarity of the electric charge of the toner to be transferred and the polarity of the electric potential or charge to be provided to a copying material as well as to the image transfer drum, and the preferred combinations include the following embodiments:

1. Electric charge having an opposite polarity to that of the charge of the toner used is provided to a copying material from the reverse side thereof, no electric charge is particularly provided to the image transfer drum, and the conductive base is grounded.

2. Electric charge having an opposite polarity to that of the charge of the toner is provided to a copying material from the reverse side thereof, and to the image transfer drum is applied a bias voltage of the same polarity as that of the toner.

3. Electric charge of an opposite polarity to that of the charge of the toner is provided to a copying material from the reverse side thereof, and to the image transfer drum a bias voltage of the same polarity as or an opposite polarity to that of the toner is changeably applied, the polarity change being made according to the progress of the image transfer process.

4. Electric charge of an opposite polarity to that of the charge of the toner is provided to a copying material from the reverse side thereof, and to the surface of the image transfer drum is provided electric charge of the same polarity as that of the toner.

5. Electric charge of an opposite polarity to that of the charge of the toner is provided to a copying material from the obverse side thereof, and to the image transfer drum a bias voltage of the same polarity as or an opposit polarity to that of the toner is changeably applied, the polarity change being made according to the progress of the image transfer process.

6. Electric charge of an opposite polarity to that of the charge of the toner is provided to a copying material from the obverse side thereof, and to the surface of the image transfer drum is provided electric charge of the same polarity as that of the toner.

7. Electric charge of the same polarity as that of the charge of the toner is provided to a copying material from the reverse side thereof, and to the image transfer drum is applied a bias voltage of an opposite polarity to that of the toner.

8. Electric charge of the same polarity as that of the charge of the toner is provided to a copying material from the reverse side thereof, and to the surface of the image transfer drum is provided electric charge of an opposite polarity to that of the toner.

9. Electric charge of the same polarity as that of the charge of the toner is provided to a copying material from the obverse side thereof, and to the image transfer drum is applied a bias voltage of an opposite polarity to that of the toner.

10. Electric charge of the same polarity as that of the charge of the toner is provided to a copying material from the obverse side thereof, and to the surface of the image transfer drum is provided electric charge of an opposite polarity to that of the toner.

In addition, the image transfer device of the present invention may, if necessary, have additional means such as a copying material neutralizer, copying material-holding drum neutralizer, copying material-holding drum cleaner, sensor for register, etc., in addition to the foregoing copying material separation means.

The image transfer device of this invention may be used in combination with various color image forming means of the prior art which use the three-color separation process or with various multicolor image forming means of the prior art including the black image elimination process as disclosed in, e.g., Japanese Patent Examined Publication No. 34770/1973 and Japanese Patent O.P.I. Publication No. 5561/1981, and the like, in addition to ordinary monochromatic image forming means. Also, the device of this invention may have a paper feed means to provide a copying material such as sheets of copying paper and a fixing means to fix the image transferred by this device, both being of the prior art.

Reference is now made to the following preferred examples for illustrating in detail the function of the image transfer device of this invention.

The following description is all made with respect to the case where a positive electrostatic latent image-forming selenium-type or positively chargeable amorphous silicon-type photosensitive layer is used; i.e., where a negatively charged toner is used, but even when a negatively chargeable-type photosensitive layer such as of zinc oxide, cadmium sulfide, various organic photoreceptors, negatively chargeable amorphous silicon or the like, is used, the function and effect thereof are the same except only that the above polarity of electrostatic charge is all reverse. And the photoreceptor to be used may be not only in the drum form but also in the belt form or various other forms.

EXAMPLE 1

FIG. 1 is a schematic drawing showing an image transfer device wherein electric charge of an opposite polarity to that of the charge of a toner is provided to a copying material from the reverse side thereof, and to the image transfer drum a bias voltage of the same polarity as or an opposite polarity to that of the toner is changeably applied.

In this device, in the course of the image transfer process, to the image transfer drum a bias voltage is applied with its polarity timely changed to being opposite to or the same (opposite to the polarity when a copying material is first charged) as that of the toner to thereby accelerate the transfer of the toner onto the copying material and simultaneously electrostatically attract and fix the copying material to the surface of the image transfer drum.

In the figure, 1 is an image carrier drum comprised of a conductive base 1 and a photoconductive photosensitive layer 2, and 3 is an image transfer drum comprised of a conductive base 3, conductive elastic layer 4, and an insulating layer 5. The figure shows an instance wherein a selenium-type or positively chargeable amorphous silicon-type positive electrostatic latent image-formable photosensitive layer is used.

To image transfer drum 3 is applied a negative or positive bias voltage by bias power supplies 6 and 6' changeable by a switch circuit SW.

Although the applied voltage and the polarity thereof differ according to the electrostatic nature of a toner, the bias voltage of the same polarity as that of the toner is preferably from 100 V to 300 V, and the bias voltage of an opposite polarity to that of the toner is preferably from 200 V to 800 V (any of the voltages is to ground potential).

Image carrier drum 1 and image transfer drum 3 are pressedly contacted at the transfer position A with each other, and, during their operation, rotate at the same circumferential rate in the directions of arrows B and C, respectively (in FIG. 1, both drums are drawn spacing apart for the convenience of representing in the model form their condition during the image transfer). At the time of starting the operation of the device, a negative bias voltage is applied to the image transfer drum.

The electrostatic latent image formed on image carrier drum 1 is developed by a developing means (not shown) containing a negatively charged toner to thereby form a toner image. Numbered 9 is the toner that is forming a toner image.

Figure 2:
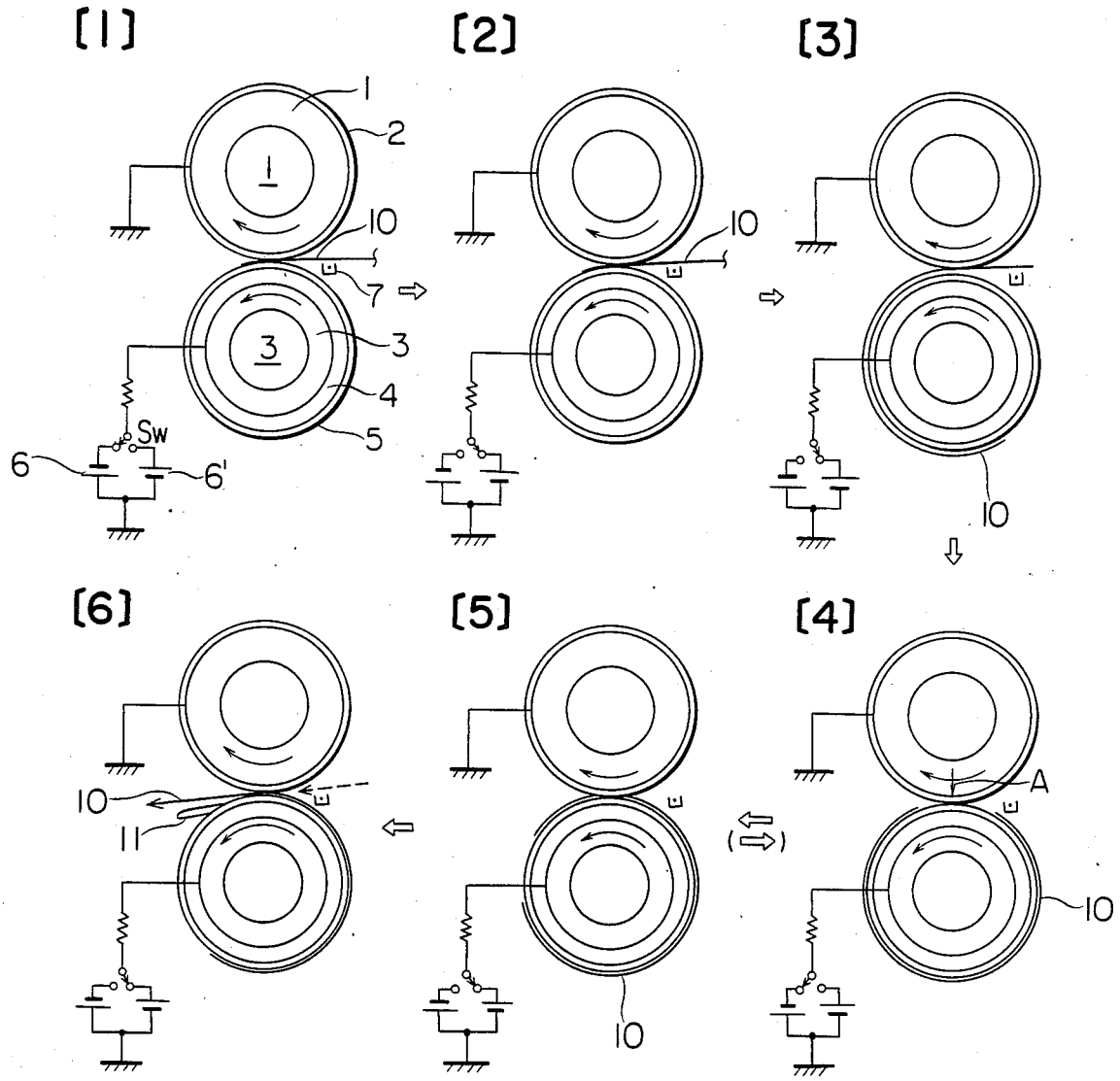
FIGS. 2 and 13 each is an explanatory drawing showing the image transfer process.

A copying material 10 (its length is shorter than the circumference of copying material-holding drum 3) advancing in the direction of arrow D by a transport means not shown in the figure is given a positive charge which is opposite to the polarity of the toner from the reverse side thereof by a corona discharger 7 and comes into the transfer position where image carrier drum 1 and copying material-holding drum 3 are in contact with each other. The negatively charged toner particles 9 are attracted by the positive charge on the surface of the copying material to be transferred to the copying material 10 side to thereby complete the transfer of a first toner image. When coming out of the contact position between both drums, the leading end of copying material 10 is subjected to the electrostatic attractions from both drums, but the negatively charged copying material 10 is more strongly attracted by the bias voltage-applied transfer drum 3 to be fixed onto the surface thereof (FIG. 2-[1]). The bias voltage to the transfer drum is changed to be positive at the point of time when the leading end of the copying material 10 advances by several or 10 mm on transfer drum 3 (the condition shown in FIG. 2-[2]). When the bias voltage applied to transfer drum 3 is negative, it is very effective to attract the copying material 10 to transfer drum 3, but because the toner 9 is negatively charged, the transfer and adherence of the toner to copying material 10 are weakened. Upon this, changing the bias voltage to be positive causes the toner to be strongly attracted to the transfer drum 3 side, thus improving the toner transfer efficiency and the quality of the transferred image. The bias polarity change weakens, on the contrary, the attraction of copying material 10 to transfer drum 3 at the contact position, but, for the holding of copying material on transfer drum 3, the adherence of the leading end of copying material 10 to transfer drum 3 when the leading end comes into and gets out of the contact position between the image carrier drum 1 and transfer drum 3 is most important, and if the approximately 10 mm part of the leading end of copying material 10 is securely held and passes through the position A, even though the attraction of the copying material to the transfer drum may become weakened in the following part of the copying material, the adherence of the copying material to the transfer drum continues, and thus copying material 10 does not slip out of place at all and, as it is, wraps around the transfer drum 3, so that copying material 10 is securely held (FIG. 2 [3]). After the transfer drum 3 makes one revolution upon completion of the image transfer shown in FIG. 1, when the leading end of copying material 10 for the transfer of a second toner image comes into the transfer position, the bias voltage is again changed to be of netative polarity to strengthen the attraction of the copying material to the transfer drum at the contact position to prevent possible slippage of the copying material (FIG. 2 [4]), and after the leading end of copying material 10 passes through the transfer position A, the polarity of the bias voltage is returned to positive polarity, and the image transfer is then continued (FIG. 2 [5]). The process of FIG. 2 [4]-[5]is repeated if necessary, and after the completion thereof a copying material-separation means such as a separation claw 11 is activated to peel the copying material 10 apart from transfer drum 3 (FIG. 2 [6]), and the copying material is then sent to a fixing section (not shown), whereby a multicolor image is obtained.

In addition, in the case of obtaining a monochromatic image, if the device is settled in the mode of FIG. 2[6]from the beginning, then the copying material comes in through the path shown with the dotted line in the figure, and the transfercompleted copying material 10 is at once separated to be sent to the fixing section, and thus rapid and successive copying operation can be carried out. This is the advantage obtained only in the image transfer device of this invention having no copying detention means on the image transfer drum thereof and allowing the use of the transfer drum at an arbitrary position. On the other hand, in a device having a detention means, even in the case of monochromatic image copying, it requires the operations such as register, detention, detention release, etc., thus making it difficult to perform its copying operation rapidly.

The changeover of the bias voltage in the above-mentioned process may be made by electrically or mechanically timely operating the switch circuit SW according to the control sequence of the foregoing electrostatic recording apparatus body or the signal from the image carrier drum or from the reading for the revolution of the transfer drum, or the like.

Figure 3:
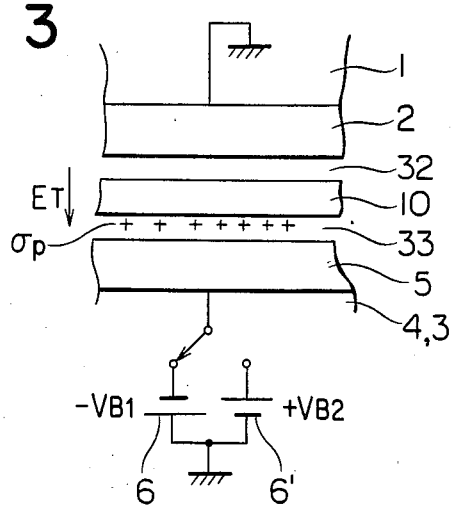
FIGS. 3 and 14 each is a schematic representation showing the contact condition of and between the image carrier drum, copying material, and image-transfer drum.

Reference is now made to FIG. 3 for illustrating the requirements for well performing the image transfer and adequately holding a copying paper on the transfer drum.

FIG. 3 is a schematic representation of the cross-sectional view of the contact position as the image transfer position between both drums, wherein if the specific inductive capacity of photosensitive layer 2 of photoreceptor 1 is expressed as $\epsilon m$, the thickness of the layer as dm, the width of gap 23 as da, the thickness of a copying paper as dp, the specific inductive capacity of the paper as $\epsilon p$, electric charge as $\sigma p$, the width of gap 33 as db, the specific inductive capacity of the insulating layer 5 of transfer drum 3 as $\epsilon d$, the thickness of the insulating layer as da, and bias voltages as $-V_{B1}$ (only the leading end of the copying paper) and $+V_{B2}$, then the transfer electric field $E_T$ (the vector direction is shown in the figure) is expressed by the following formula:

$$E_T = \frac{-\left(d_b + \frac{d_d}{\epsilon_d}\right)\sigma_p \begin{matrix} +\epsilon_o V_{B1} \\ -\epsilon_o V_{B2} \end{matrix}}{\epsilon_o\left(\frac{d_m}{\epsilon_m} + d_a + \frac{d_p}{\epsilon_p} + d_b + \frac{d_d}{\epsilon_d}\right)}$$

And when the value of $E_T$ is negative, the transfer of a negatively charged toner is possible.

And the electric field $E_1$ which attracts the copying paper to the photoreceptor side is expressed by the formula:

$$E_1 = \frac{-\left(d_b + \frac{d_d}{\epsilon_d}\right)\sigma_p \begin{matrix} +\epsilon_o V_{B1} \\ -\epsilon_o V_{B2} \end{matrix}}{\epsilon_o\epsilon_p\left(\frac{d_m}{\epsilon_m} + d_a + \frac{d_p}{\epsilon_p} + d_b + \frac{d_d}{\epsilon_d}\right)}$$

When this value is negative, the copying paper is attracted to the photoreceptor side, and its force $F_1$ is expressed by the formula:

$$F_1 = \frac{\left(-\left(d_b + \frac{d_d}{\epsilon_d}\right)\sigma_p \begin{matrix} +\epsilon_o V_{B1} \\ -\epsilon_o V_{B2} \end{matrix}\right)^2}{2\epsilon_o\epsilon_p\left(\frac{d_m}{\epsilon_m} + d_a + \frac{d_p}{\epsilon_p} + d_b + \frac{d_d}{\epsilon_d}\right)^2}$$

On the other hand, the electric field $E_2$, which attracts the copying paper to the transfer drum side, is expressed by the formula:

$$E_2 = \frac{\left(\frac{d_m}{\epsilon_m} + d_a + \frac{d_p}{\epsilon_p}\right)\sigma_p \begin{matrix} +\epsilon_o V_{B1} \\ -\epsilon_o V_{B2} \end{matrix}}{\epsilon_o\left(\frac{d_m}{\epsilon_m} + d_a + \frac{d_p}{\epsilon_p} + d + \frac{d_d}{\epsilon_d}\right)}$$

When this value is positive, the copying paper is attracted to the photoreceptor side and its force $F_2$ is expressed by the formula:

$$F_2 = \frac{\left(\left(\frac{d_m}{\epsilon_m} + d_a + \frac{d_p}{\epsilon_p}\right)\sigma_p \begin{matrix} +\epsilon_o V_{B1} \\ -\epsilon_o V_{B2} \end{matrix}\right)^2}{2\epsilon_o\left(\frac{d_m}{\epsilon_m} + d_a + \frac{d_p}{\epsilon_p} + d_b + \frac{d_d}{\epsilon_d}\right)^2}$$

In order that the image transfer is well performed, $|E_T|$ is required to be not less than 100 KV/cm, and preferably not less than 350 KV/cm.

And in order that the copying paper wraps around the transfer drum, when the leading end of the copying paper, i.e., the bias voltage is at least $-V_{B1}$, the relation of $$|F_1| < |F_2| \quad (1)$$

is required to be established.

By substituting the values of $F_1$ and $F_2$ for the above (1), the requirements for the respective parameters can be obtained, and by determining part of the parameters, favorable other parameters can be obtained.

As will be described hereinafter, in a device where a satisfactory image transfer was actually performed, it was made certain that the above requirements were satisfied.

The following is an example of the application of this device to a color copier based on the three-color separation process.

Figure 4:
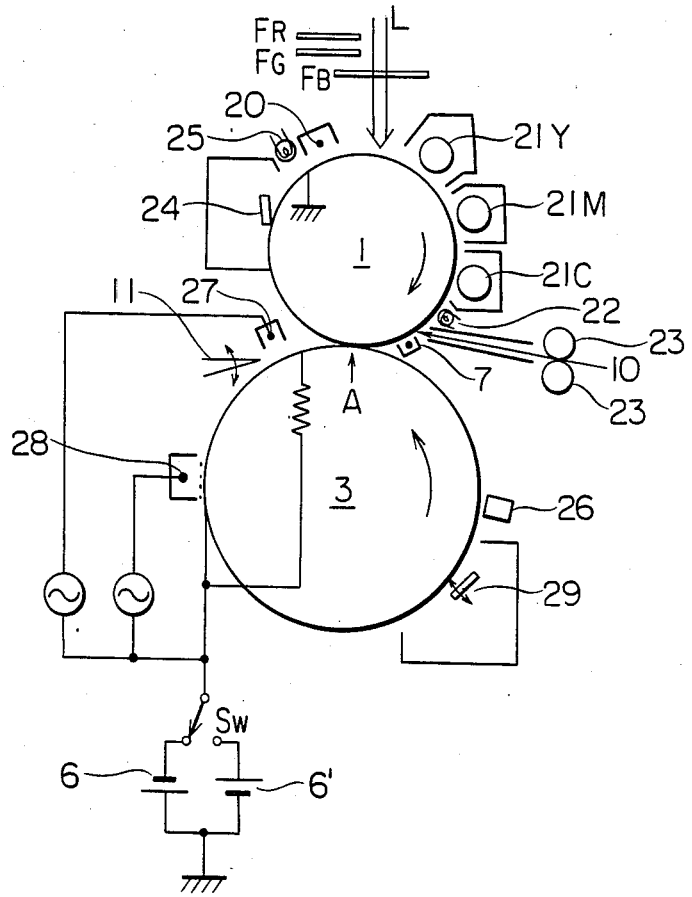
FIGS. 4, 9, 11, 15 and 18 each is a schematic illustration of color copying apparatus which uses the image transfer device of this invention.

FIG. 4 is a schematic illustration of the image forming section and image transfer section of a color copying apparatus which uses the image transfer device of this invention. Also in this figure, the same functions-having members as those defined in FIG. 1 are indicated with the same numbers. In this figure, arrow L represents the optical path of the imagewise exposure light that has scanned an original image sent from an optical system not shown in this figure. The scanning is repeated three times, and each time, one after the others, Filters $F_R$ (red), $F_G$ (green) and $F_B$ (blue) each is inserted into optical path L to thereby perform separation exposures. The figure shows that Filter $F_B$ is in the optical path. The development was performed by using a two-component developer.

is a photoreceptor drum having the same construction as that of the image carrier drum of FIG. 1, and uses a Se-Te photoreceptor whose specific inductive capacity $\epsilon m=6$ and whose thickness $dm=60$ μm. The drum rotates in the direction of the arrow, and is given overall positive charge by corona discharger 20, and then imagewise exposed to the light coming through optical path L. Firstly, the blue filter is inserted in the optical path to make an exposure to form an electrostatic image on photoreceptor drum 1, and then developed by a developing means 21Y containing a negatively charged yellow toner to thereby form an yellow toner image. The yellow toner image-carrying photoreceptor drum is neutralized by a neutralizer lamp 22 prior to image transfer, and then advances the image to the transfer position A.

On the other hand, a copying paper 10 that has been brought through paper feed rollers 23 is given a positive charge of $3\times10^{-4}$ c/m$^2$ to the reverse thereof by discharger 7 and then sent to the transfer position A to be put in between photoreceptor drum 1 and transfer drum 3, thus starting the transfer of the yellow toner image. In the meantime, transfer drum 3 is given a negative bias voltage $V_{B1}$ of $-200$ V by bias power supply 6 to strongly attract the copying paper 10, but after the about 10 mm of the leading end of the copying paper passes the position A, the bias is changed over to a bias $+V_{B2}$ of $+500$ V from power supply 6' according to the operation of SW to thereafter continue the transfer of the yellow toner image.

Transfer drum 3 has the same construction as that of FIG. 1, but details are omitted in this figure. The diameter of transfer drum 3 is 150 mm, and the conductive elastic layer thereof is comprised of a conductive rubber having a thickness of 2 mm, a hardness of 50°, and a volume resistivity of $10^5\Omega$ cm. The insulating layer of the drum is a polyester having a thickness $d_d$ of 25 μm and a specific inductive capacity $\epsilon d$ of 3.

The copying paper used herein has a specific inductive capacity $\epsilon p$ of 2 and a thickness $d_p$ of 100 μm. The gap $d_a$ between the photoreceptor and the copying paper is 1 μm, and the gap $d_b$ between the transfer drum and the copying paper is also 1 μm.

The photoreceptor drum, after the image transfer, is cleard of its surface-residual toner by a cleaning device 24, and reused after removing the residual charge by neutralizer lamp 25.

The copying paper 10 held on transfer drum 3 advances with the revolution of the drum 3, and the position of the paper is read by a sensor 26, which causes a second exposure operation to start synchronously with the position. The second exposure uses the green filter $F_G$, and the development is carried out by developing means 21M containing a negatively charged magenta developer. The obtained negative toner image is superposedly transferred onto the yellow image on the copying paper 10 that is held on the transfer drum and comes into the position A. The bias voltage to be applied to transfer drum 3 is changed to negative voltage before the copying paper 10 reaches the position A to thereby strongly attract the copying paper 10 to transfer drum 3, so that the copying paper 10 is by no means affected to slip out of place by pressure caused when the paper comes into the position between both drums, and thus the transfer of the magenta toner image onto the correct position can be carried out. After the about 10 mm of the leading end of the copying paper passes the position A, the polarity of the bias is returned to positive polarity. The previously transferred yellow toner is strongly attracted to the copying material side not only by the positive charge of the copying paper but also by the positive bias applied to transfer drum 3, so that the yellow image is by no means disturbed or retransferred to photoreceptor drum 1 when the magenta toner image is transferred to be superposed thereon.

Further, a cyan toner image that has been obtained through similar processes;-the imagewise exposure through red filter $F_R$ and the development by developing means 21C containing a cyan developer—is transferred to and superposed on the above transferred toner image of the copying paper. The cyan toner image transfer-completed copying paper 10 is subjected to AC corona discharge to be neutralized by a copying material neutralizing corona discharger 27, and separated from the surface of the drum 3 by putting separation claw 11 down toward the transfer drum 3 side, and then sent to a heat roller fixing means (not shown) thereby to be fixed. The three color toners transferred onto the copying paper are fused to be mixed in the fixing process, whereby a color image by the subtractive color process is reproduced.

After the separation of the copying paper, the transfer drum 3 is neutralized by transfer drum neutralizer 28, and then cleared of the toner attached thereto by transfer drum cleaner 29 to be ready for the subsequent copying operation cycle.

In order to perform monochromatic image copying operation by this device, a single unit of developing means alone is operated, separation claw 11 is kept in its down position, and neutralizer 27 is continuously operated, whereby monochromatic image copies can be successively and rapidly obtained.

The parameters of this example are listed as follows:

Photoreceptor: Se/Te $\epsilon m=6$, $dm=60$ μm da, db: 1 μm

Paper: $\epsilon p=2$, $dp=100$ μm $\sigma p$: $3\times10^{-4}$ C/m$^2$ $-V_{B1}$: $-200$ V $+V_{B2}$: $+500$ V Insulating layer: Polyester $d=3$, $d_d=25$ μm The values of $E_T$, $E_1$, $E_2$, $F_1$ and $F_2$ calculated using these parameters are as follows, and it is certain that these values satisfy the foregoing requirements for holding the copying paper.

| When the bias is $-VB_1$ | When the bias is $+VB_2$ |
|---|---|
| $E_T = -1.4\times10^6$ V/m | $-1.2\times10^7$ V/m |
| $E_1 = -7\times10^5$ V/m | $-6\times10^6$ V/m |
| $E_2 = 3.2\times10^7$ V/m | $2.2\times10^7$ V/m |
| $F_1 = 4.4$ N/m$^2$ | $3.2\times10^2$ N/m$^2$ |

-continued

| When the bias is $-VB_1$ | When the bias is $+VB_2$ |
|---|---|
| $F_2 = 4.6 \times 10^3$ N/m$^2$ | $2.2 \times 10^3$ N/m$^2$ |

The above example has been described about the color image copying operation using ordinary three-color separation filters and yellow, magenta and cyan color toners, but it goes without saying that color separation filters, the number of color toners, the number of developing means, etc., usable in this invention are not limited to the above.

Figure 5:
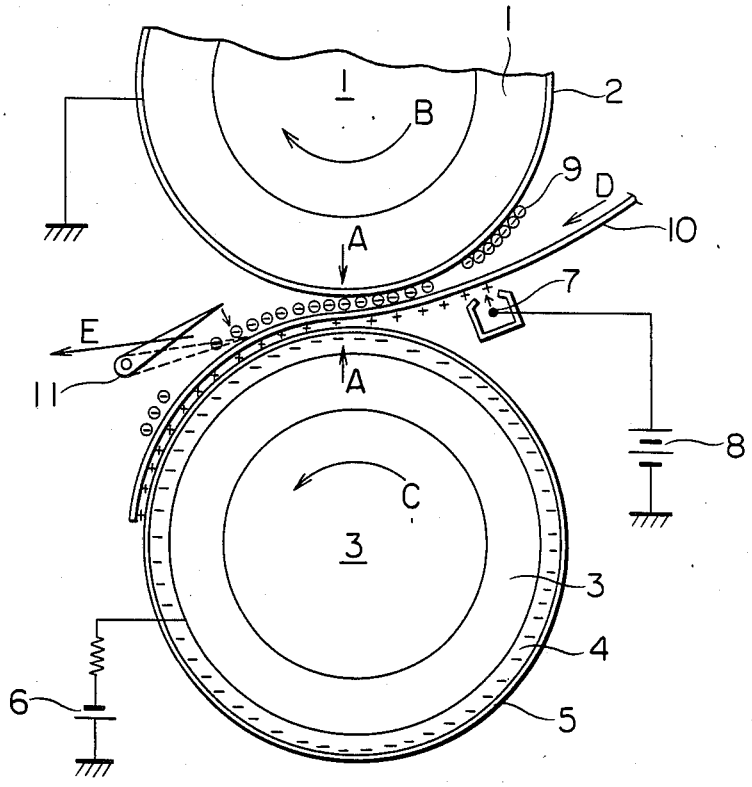
Figure 6:
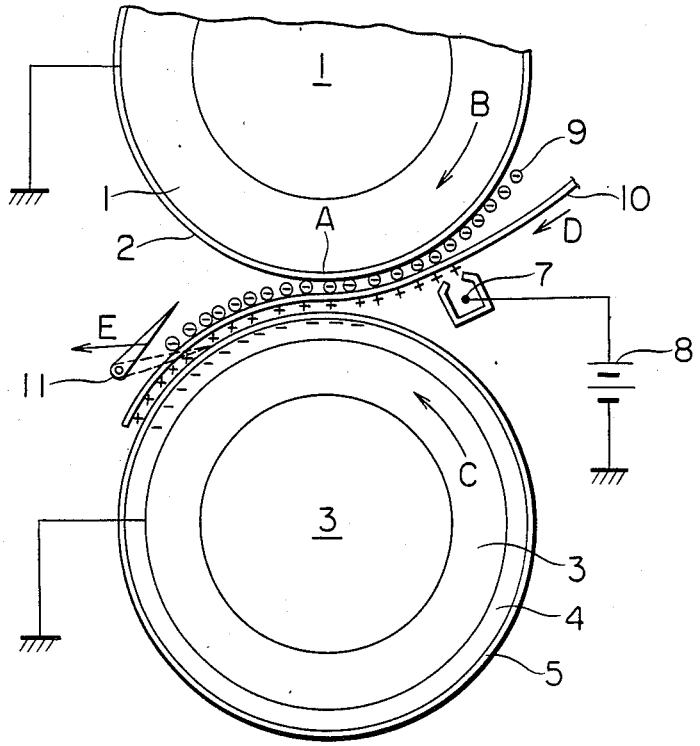

FIGS. 5 and 6 show device examples remodelled by simplifying the device of FIG. 1. FIG. 5 shows an example in which only the bias of the same polarity as that of a toner is applied to the transfer drum, and FIG. 6 shows an example in which the transfer drum is grounded.

In the example of FIG. 5, negatively charged toner 9 is attracted by the positive charge of the copying paper thereby to be transferred onto the copying paper 10, and thus image transfer is carried out, and the copying paper is attracted and fixed onto transfer drum 3 by the negative bias voltage thereof. In the example of FIG. 6, underneath the insulating layer of the transfer drum is induced an negative potential corresponding to the positive charge on the reverse of the copying paper, whereby the copying paper is fixed onto the transfer drum.

EXAMPLE 2

Figure 7:
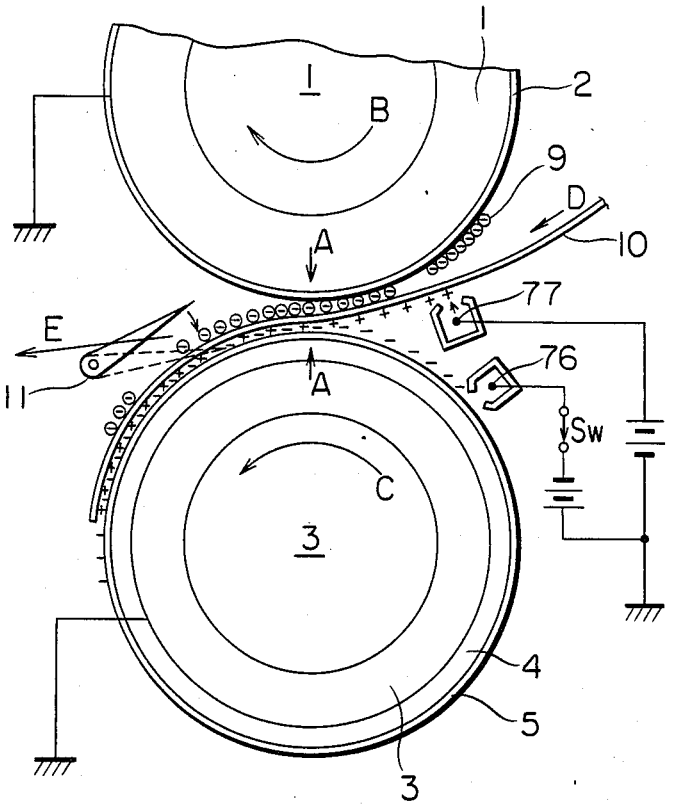

FIG. 7 is a schematic drawing showing an image transfer device having a charge-proving means which provides electric charge of an opposite polarity to that of the toner used to a copying material from the reverse thereof, and provides electric charge of the same polarity as that of the toner to the surface of the transfer drum.

The polarity of the charge to be provided in this device is the same as that of the toner for the copying material and opposite to that of the toner for the transfer drum, but, in the case of using a corona discharger as charge-providing means, the applied voltage to the discharger, although different according to the image carrier, nature of the toner used, etc., is preferably from 5 to 8 KV (its polarity is opposite to that of the toner) for the copying material charge-providing corona discharger. For the transfer drum, the charge is desirable to be provided so that the surface potential thereof is from 100 to 300 V (its polarity is the same as that of the toner), and for this purpose a voltage of from 4 to 6 KV (its polarity is the same as that of the toner) is desirable to be applied to the transfer drum charge-providing corona discharger.

That is, this device provides electric charge of an opposite polarity to that of the toner to the copying material to accelerate the image transfer, and at the same time provides electric charge of the same polarity as that of the toner, i.e., of an opposite polarity to that of the copying material, to the surface of the transfer drum, and attracts and fixes the copying material by the electrostatic attraction.

In the figure, 1 is an image carrier drum comprised of a conductive base 1 and conductive photosensitive layer 2, and 3 is a transfer drum comprised of conductive base 3, conductive elastic layer 4 and insulating layer 5. The figure shows the case where a photosensitive layer such as of amorphous silicon which forms a positively charged electrostatic image is used.

Transfer drum 3 is grounded and the surface thereof is negatively charged by transfer drum charge-providing corona discharger 76. 77 is a copying material charge-providing corona discharger located opposite to the image carrer drum and to this discharger is applied a positive voltage.

Image carrier drum 1 and image transfer drum 3 are pressedly contacted at the transfer position A with each other, and during their operation both drums rotate in the direction of the arrows B and C, respectively (in the figure both drums are drawn spacing apart for the convenience of showing their condition in the pattern form).

The electrostatic image formed on image carrier drum 1 is developed by a developing means (not shown) containing a negatively charged toner to thereby form a toner image. 9 is the toner that is forming a toner image.

The copying material 10 (its length is shorter than the circumference of copying material-holding drum 3), which is caused to advance in the direction of arrow D by a feed means (not shown), is given from the reverse thereof a positive charge which is opposite polarity to that of the toner by a corona discharger 77, and comes into the transfer position between image carrier drum 1 and copying material-holding drum 3. The negatively charged toner particles are attracted by the positive charge on the reverse of the copying material thereby to be transferred onto the copying material, thus completing the transfer of a first toner image. The copying material, when getting out of the contact position between both drums, is subjected to the electrostatic attractions from both drums, but is more strongly attracted to the surface of transfer drum 3, which is in advance negatively charged by transfer drum charge-providing corona discharger 76, and wraps arround and is fixed to the surface of the drum. The copying material, because of being contacted overall with and strongly attracted to the transfer drum, by no means slips out of place in the subsequent process. The copying material 10, wrapping around transfer drum 3, comes again into the transfer position A according to the revolution of the drum 3 to thereby effect the transfer of a second toner image. Corona discharger 76, at the point of time when the transfer drum has completed its one revolution without being subjected to discharge, activates switch SW to stop the operation of the drum. Afterward, the same transfer process is repeated a necessary number of times to thereby complete a color image on the copying material 10.

In the mean time, the positive charge given to the reverse of the copying material, because the surface of the transfer drum is insulation, is maintained unattenuated, and therefore the toner is satisfactorily transferred.

After completion of the image transfer, a separation means such as a separation claw may be used to separate the copying material from the copying material-holding drum to send the copying material to the fixing process. In the figure, 11 is the separation claw. If this claw is moved down to the position indicated with a broken line, the copying material 10 is separated by the claw from the drum 3 and advances in the direction of arrow E. In addition, for monochromatic image copying operation, if this mode is used from the beginning, the transfer-completed copying material is ejected at once in the direction of arrow E, thus enabling to make monochromatic copies rapidly and successively.

Similarly to the device in the previous example, the device in this example also may, if necessary, have additional means such as a copying material neutralizer, copying material-holding drum neutralizer, copying material-holding drum cleaner, sensor for register, etc., in addition to the copying material separation means. The color image forming means and others usable in combination with this device are similar to those described in Example 1.

Figure 8:
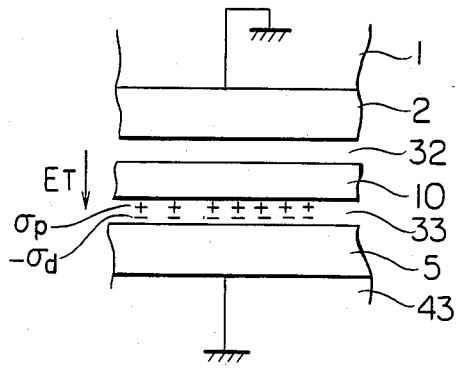

Reference is now made to FIG. 8 for illustrating the requirements for satisfactorily performing the image transfer and adequately holding a copying paper on the transfer drum.

FIG. 8 is a schematic representation of the cross-sectional view of the contact portion as the transfer position in FIG. 1 (the position A in FIG. 1), wherein if the specific inductive capacity of the photosensitive layer 2 of photoreceptor 1 is expressed as $\epsilon m$, the thickness thereof as dm, the width of gap 32 as da, the thickness of a copying paper as dp, the specific inductive capacity of the paper as $\epsilon p$, electric charge as $\theta p$, the width of gap 33 as db, the specific inductive capacity of insulating layer 5 of transfer drum 3 as $\epsilon d$, the thickness of the layer as da, and voltage as $-\sigma d$, then the transfer electric field $E_T$(the vector direction is shown in the figure) is expressed by the formula:

$$E_T = \frac{-\left(d_b + \frac{d_d}{\epsilon_d}\right)\sigma_p + \frac{d_d}{\epsilon_d}\sigma_d}{\epsilon_o\left(\frac{d_m}{\epsilon_m} + d_a + \frac{d_p}{\epsilon_p} + d_b + \frac{d_d}{\epsilon_d}\right)}$$

When the value of $E_T$ is negative, the transfer of a negatively charged toner is possible.

The electric field $E_1$, which attracts the copying paper to the photoreceptor side, is expressed by the formula:

$$E_1 = \frac{-\left(d_b + \frac{d_d}{\epsilon_d}\right)\sigma_p + \frac{d_d}{\epsilon_d}\sigma_d}{\epsilon_o\epsilon_p\left(\frac{d_m}{\epsilon_m} + d_a + \frac{d_p}{\epsilon_p} + d_b + \frac{d_d}{\epsilon_d}\right)}$$

If this value is negative, then the copying paper is attracted to the photoreceptor side, and its force $F_1$ is:

$$F_1 = \frac{\left(-\left(d_b + \frac{d_d}{\epsilon_d}\right)\sigma_p + \frac{d}{\epsilon_d}\sigma_d\right)^2}{2\epsilon_o\epsilon_p\left(\frac{d_m}{\epsilon_m} + d_a + \frac{d_p}{\epsilon_p} + d_b + \frac{d_d}{\epsilon_d}\right)^2}$$

On the other hand, the electric field $E_2$, which attracts the copying paper to the transfer drum side, is expressed by the formula:

$$E_2 = \frac{\left(\frac{d_m}{\epsilon_m} + d_a + \frac{d_p}{\epsilon_p}\right)\sigma_p + \frac{d_d}{\epsilon_d}\sigma_d}{\epsilon_o\left(\frac{d_m}{\epsilon_m} + d_a + \frac{d_p}{\epsilon_p} + d_b + \frac{d_d}{\epsilon_d}\right)}$$

When this value is positive, the copying paper is attracted to the photoreceptor side, and its force $F_2$ is:

$$F_2 = \frac{\left(\left(\frac{d_m}{\epsilon_m} + d_a + \frac{d_p}{\epsilon_p}\right)\sigma_p + \frac{d_d}{\epsilon_d}\sigma_d\right)^2}{2\epsilon_o\left(\frac{d_m}{\epsilon_m} + d_a + \frac{d_p}{\epsilon_p} + d_b + \frac{d_d}{\epsilon_d}\right)^2}$$

In order that the image transfer is well performed, the $|E_T|$ is required to be not less than 100 KV/cm, and preferably not less than 350 KV/cm.

And in order that the copying paper wraps around the transfer drum, it is necessary to establish the following relation:

$$|F_1| < |F_2| \quad (1)$$

By substituting the values of $F_1$ and $F_2$ for the above (1), the condition of each of the parameters can be obtained, and by determining part of the parameters, suitable other parameters can be obtained.

As will be described hereinafter, in a device where a satisfactory image transfer was actually performed, it was confirmed that these satisfied the requirements for the holding of the copying material by the foregoing transfer drum.

The following is an example of the application of this device to a color copying apparatus based on the three-color separation process.

Figure 9:
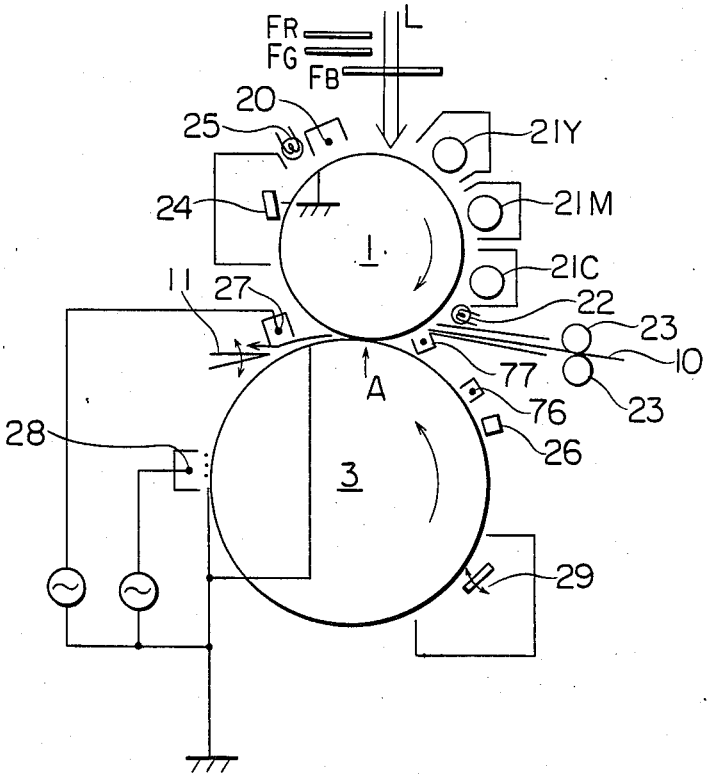

FIG. 9 is a schematic illustration of the image forming and image transfer sections of a color popying apparatus which uses the image transfer device of this invention. Also in this figure, the members having the same function as those defined in FIG. 4 are numbered in the same way. In this figure, arrow L is the optical path of the imagewise exposure light that has scanned an original image sent from an optical system not shown in this figure. The scanning is repeated three times, and each time, one after the others, filters $F_R$ (red), $F_G$ (green) and $F_B$ (blue) each is inserted into optical path L to thereby perform separation exposures. This figure shows that the blue filter $F_B$ is in the optical path. The development was performed by using a two-component developer.

1 is a photoreceptor drum having the same construction as that of the image carrier drum of FIG. 7, and uses a Se-Te photoreceptor whose specific inductive capacity is 6 and whose thickness is 60 $\mu$m. The drum rotates in the direction of the arrow, and is given overall positive charge by corona discharger 20, and then imagewise exposed to the light coming through optical path L. Firstly, the blue filter is inserted in the optical path to make an exposure to form an electrostatic image on photoreceptor drum 1, and then developed by a developing means 21Y containing a negatively charged yellow developer to thereby form an yellow toner image. The yellow toner image-carrying photoreceptor drum is neutralized by a neutralizer lamp 22 prior to image transfer, and then advances the image to the transfer position A.

On the other hand, a copying paper 10 that has been brought through paper feed rollers 23 is given a positive charge of $4\times10^{-4}$ c/m$^2$ to the reverse thereof by discharger 7 and then sent to the transfer position A to be put in between photoreceptor drum 1 and transfer drum 3, and thus the yellow toner image is transferred. Transfer drum 3, however, is in advance given a negative charge of $-5.3\times10^{-5}$ C/m$^2$ by transfer drum charge-providing corona discharger 7 prior to being in contact with the copying paper 10.

Transfer drum 3 has the same construction as that of FIG. 7, but details are omitted in this figure. The diameter of transfer drum 3 is 150 mm, and the conductive elastic layer thereof is comprised of a conductive rubber having a thickness of 2 mm, a hardness of 50°, and a volume resistivity of $10^5\Omega$ cm. The insulating layer of the drum is a polyester having a thickness dd of 100 $\mu$m and a specific resistivity $\epsilon$d of 3.

The copying paper used herein has a specific inductive capacity $\epsilon$p of 2 and a thickness dp of 100 $\mu$m. The gap da between the photoreceptor and the copying paper is 1 $\mu$m, and the gap db between the transfer drum and the copying paper is also 1 $\mu$m.

The transfer-completed copying paper 10 wraps around and is held on the negatively charged transfer drum 3 due to the electrostatic attraction and is moved.

The photoreceptor drum, after the image transfer, is cleared of its surface residual toner by a cleaning means 24, and reused after removing the residual charge by neutralizer lamp 25.

The copying paper 10, held on transfer drum 3, advances with the revolution of the drum 3, and the position of the paper is read by a sensor 26, which causes a second exposure operation to start synchronously with the position. At this moment the discharge by corona discharger 6 to the surface of the transfer drum is stopped. The second exposure uses the green filter $F_G$, and the development is performed by developing means 21M containing a negatively charged magenta developer. The obtained magenta toner image is superposedly transferred onto the yellow image on the copying paper 10, which is held on the transfer drum and coming into the position A. The yellow toner is attracted to the copying paper by the positive charge thereof, so that the image is not disturbed nor retransferred to the photoreceptor drum 1 side.

Further, onto the above-produced toner image is superposedly transferred a cyan toner image that has been obtained by similar processes; the exposure through the red filter $F_R$ and the development by developing means 21C containing a cyan developer. The cyan toner image transfer-completed copying paper 10 is neutralized by being subjected to an AC corona discharg from transfer material-neutralizing corona discharger 27, then separated from the drum 3 by separation claw 11, which is moved down toward the transfer drum 3 side, and then sent to a heat-roller fixing means (not shown), whereby the toner image is fixed. The three color toners transferred onto the copying paper 10 are fused to be mixed in the fixation, whereby a color image by the subtractive color process is reproduced.

The copying paper-separated transfer drum 3 is neutralized by transfer drum neutralizer 28, and further cleared of the toner remaining on the surface thereof by transfer drum cleaner 29, thereby to be ready for the subsequent copying operation cycle.

The respective parameters of this example are listed as follows:

Photoreceptor: Se/Te $\epsilon$m=6, dm=60 $\mu$m
da, db: 1 $\mu$m
Paper: $\epsilon$p=2, dp=100 $\mu$m
$\sigma$p: $4\times10^{-4}$ C/m$^2$
$\sigma$d: $-5.3\times10^{-5}$ C/m$^2$
Insulating layer: Polyester $\epsilon$d=3, dd=100 $\mu$m The values of $E_T$, $E_1$, $E_2$, $F_1$ and $F_2$ calculated using these parameters are as follows. These satisfy the requirements for the foreging image transfer.

$$E_T=-1.4\times10^7 V/m$$

$$E_1=-7\times10^6 V/m$$

$$E_2=3.1\times10^7 V/m$$

$$F_1=4.4\times10^2 N/m^2$$

$$F_2=4.2\times10^3 N/m^2$$

When performing monochromatic image copying operation by means of this device, a single unit of developing means alone is operated, separation claw 11 is kept in its down position, and neutralizer 27 is continuously operated, whereby monochromatic image copies can be successively and rapidly obtained.

The above example has been described about the color image copying operation using ordinary three-color separation filters and yellow, magenta and cyan color toners, but it is the same as in Example 1 that color separation filters, the number of color toners, the number of developing means, etc., usable in this invention are not limited to the above.

In addition, in the device of FIG. 7, the copying paper can be electrostatically attracted and fixed to the transfer drum also in the case where the polarity of a charge given to the copying paper from the reverse thereof is the same as that of the charge of the toner, and the transfer drum is given a charge of an opposite polarity to that of the charge of the toner. That is, in the construction shown in FIGS. 7 and 9, polarity change needs to be made so that the copying material charge-providing means 77 provides a negative charge, which is the same as the polarity of the charge of the toner, and the transfer drum charge-providing means 76 provides a positive charge, which is opposite to the polarity of the charge of the toner. Also, an appropriate adjustment of the voltage is required.

In this instance, the copying material is given a charge of the same polarity as that of the toner to thereby cause a repulsive force, but since the transfer drum is given a high electrostatic charge of an opposite polarity to that of the toner, if a smaller amount of charge is given to the copying material, the electrostatic field caused by the charge of the transfer drum overcomes the charge of the copying material to attract the toner together with the copying material to the transfer drum side, whereby the transfer and retention of the toner can be well performed.

In this case, since the charges of the toner and copying material are both opposite in the polarity to the charge of the transfer drum, the attraction of the copying material to the transfer drum becomes very strong.

The polarity of the charge to be provided to the copying material should be so settled as to be the same as that of the charge of the toner according to the polarity of the charge of the toner (determined according to the polarity of the electrostatic image formed on the image carrier) to be transferred. Where a corona discharger is used, the voltage to be applied thereto, although it depends on the image carrier and the nature of the toner used, is usually preferably from 4 to 7 KV of the same polarity as that of the toner. And where a charge is provided to the transfer drum, the surface potential thereof is desirable to be from 0.5 to 1.5 KV of an opposite polarity to that of the toner, and therefore the voltage to be applied to the transfer drum charge-providing corona discharger should be from 5 to 8 KV of an opposite polarity to that of the toner.

EXAMPLE 3

Figure 10:
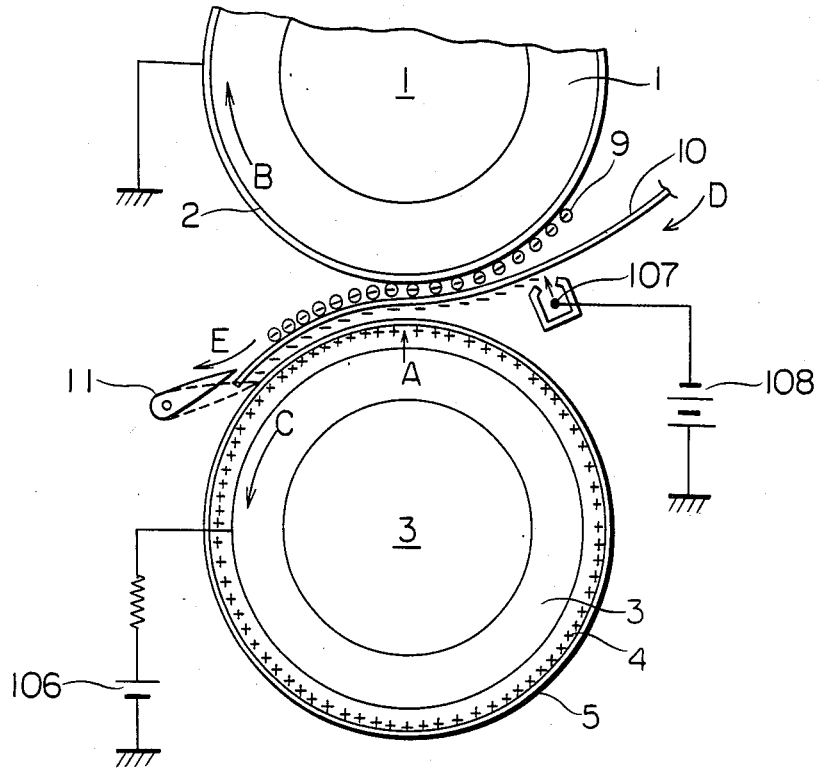

FIG. 10 shows an example of the device which provides a charge of the same polarity as that of the charge of a toner to a copying material from the reverse thereof and which applies a bias voltage of an opposite polarity to that of the charge of the toner to the transfer drum. That is, the device is intended to electrostatically attract and fix the copying material to the surface of the transfer drum by applying to the transfer drum a bias voltage of an opposite polarity to that of the charge of the copying material. In the same way as in the previous example, any detention means such as a gripper for fixing the copying material need not be provided on the transfer drum nor do any such various problems as those described previously occur, so that the doubling trouble-free superposed transfer of the toners can be carried out.

In this instance, since the copying material is given a charge of the same polarity as that of the toner, a repulsive force is produced between the toner and the copying material, but because a high opposite-bias voltage is applied to the transfer drum, if the amount of the charge to be provided to the copying material is settled low, the electrostatic field produced by the bias voltage applied to the transfer drum overcomes the charge of the copying material and attracts the toner to the transfer drum side, i.e., to the copying material, thus enabling the transfer of the toner to be well performed.

The polarity of the charge given to the reverse of the copying material, according to the charge of the toner to be transferred (determined according to the polarity of the electrostatic image formed on the image carrier), is so settled as to be the same as that of the charge of the toner. The voltage to be applied to the corona discharger, although it depends on the image carrier, nature of the toner used, etc., is usually in the range of preferably from 4 to 7 KV (absolute value). To the transfer drum, as stated above, is applied a bias voltage of the same polarity as that of the charge of the toner, and the absolute value of the applied voltage, althogh the polarity thereof depends on the image carrier, electrostatic nature of the toner used, etc., is preferably from 0.5 to 1.5 KV.

The function of this image transfer device will now be explained. FIG. 10 is a schematic drawing showing the image transfer device of this invention, wherein 1 is an image carrier drum comprised of conductive base 1 and photoconductive photosensitive layer 2, and 3 is a transfer drum comprised of conductive base 3, conductive elastic layer 4 and insulating layer 5. The figure shows the case where a positive electrostatic image-forming selenium-type or amorphous silicon-type photosensitive layer is used.

To transfer drum 3 is being applied a positive DC bias from bias power supply 106. 107 is a transfer drum chargeproviding corona discharger located opposite to the image carrier drum, and to the drum is applied a negative voltage from power supply 108.

Image carrier drum 1 and transfer drum 3 are pressedly contacted at the transfer position A with each other, and rotate in the direction of the arrows B and C, respectively, during their operation (in the figure both drums are drawn spacing apart for the convenience of showing the image-transfer condition in the pattern form).

The electrostatic image formed on image carrier drum 1 is developed by developing means (not shown) containing a negatively charged toner to thereby form a toner image. 9 is the toner that is forming a toner image.

The copying material 10 (its length is shorter than the circumference of copying material-holding drum 3), which advances in the direction of arrow D by feed means (not shown), is given a negative charge, which is of the same polarity as that of the toner, from the reverse thereof by corona discharger 7, and comes into the transfer position between image carrier drum 1 and copying material-holding drum 3. The negatively charged toner particles are attracted to be transferred to the copying material side by the positive bias voltage of the transfer drum to thereby complete the transfer of a first image. When getting out of the transfer position, the copying material is subjected to the electrostatic attractions from both drums, but the negatively charged copying material 10 is more strongly attracted by the positive bias voltage-applied transfer drum 3, so that the copying material wraps around and is fixed to the surface of the transfer drum. The copying material, since it is contacted overall with and strongly attracted to the transfer drum, by no means slips out of place in the subsequent process. The copying material 10, wrapping around transfer drum 3, again comes into the transfer position A with the revolution of the drum 3, whereby the transfer of a second toner image is performed. After that, the transfer by the same process is repeated a necessary number of times to thereby complete a multicolor image formation on copying material 10. In the meantime, the negative charge given to the reverse of the copying material remains unattenuated due to the insulating surface of the transfer drum, thus causing the transfer of the toner to be satisfactorily performed and securing the attraction of the copying material to the transfer drum.

After completion of the transfer, the copying material is separated from the copying material-holding drum by separation means such as a separation claw, and then sent to the fixing process. In the figure, 11 is a separation claw. The claw, when moved down to the position indicated with a broken line, separates the copying material 10 from the drum 3 and lets the copying material advance in the direction of arrow E. In addition, when performing monochromatic image copying operation, if the device is settled in this mode from the beginning, the transfer-completed copying material is at once ejected in the direction of arrow E, and therefore monochromatic image copies can be made rapidly and successively.

The following is an example of the application of this image transfer device to a color copying apparatus based on the three-color separation process.

Figure 11:
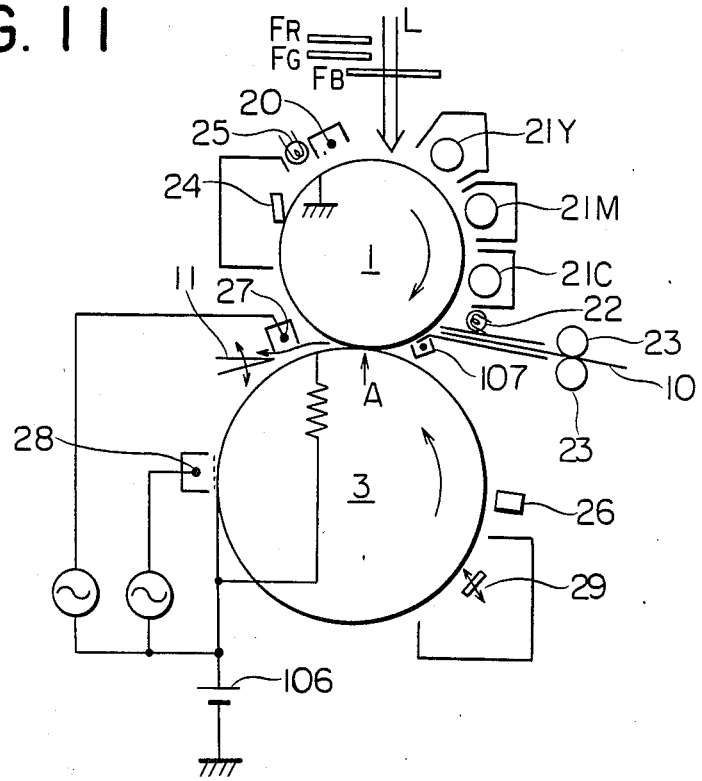

FIG. 11 is a schematic illustration of the image forming and image transfer sections of a color copying apparatus using the image transfer device of this invention. Also in this figure, the members having the same functions as those defined in FIG. 1 are indicated with the same numbers. The development was made by use of a two-component developer. In this figure, arrow L represents the optical path of an imagewise exposure, light that has scanned an original image sent from an optical system (not shown). The scanning is repeated three times, and each time, one after the others, filters $F_R$ (red), $F_G$ (green) and $F_B$ (blue) each is inserted into the optical path L to thereby perform color-separation exposures. The figure shows that the filter $F_B$ is in the optical path.

1 is a selenium-type photoreceptor (in this example, Se/Te is used which has a thickness of 60 μm and a specific inductive capacity of 6)-applied photoreceptor drum which is constructed in the same way as in the image carrier drum of FIG. 1, and rotates in the direction of the arrow. After being positively charged overall by corona discharger 20, the drum 1 is exposed imagewise to the light coming through optical path L. Firstly, the blue filter is inserted in the optical path to make an exposure to thereby form an electrostatic image on photoreceptor drum 1, and the electrostatic image is then developed by developing means 21Y containing a negatively charged yellow developer to thereby form an yellow toner image. The photoreceptor drum, carrying the yellow toner image, is neutralized by neutralizer lamp 22 prior to image transfer, and then advances to the transfer position A.

On the other hand, the copying paper 10, fed through feed rollers 23, is given from the reverse thereof a negative charge of $-2\times10^{-8}$ C/cm$^2$ by copying material charge-providing corona discharger 107, and sent to the transfer position A to be put in between photoreceptor drum 1 and transfer drum 3, and thus the yellow toner image is transferred. This transfer drum 3 is of the same construction as that shown in FIG. 1, and details are omitted in this figure. The conductive rubber layer of the transfer drum 3 in this example has a thickness of 2 mm, a hardness of 50° and a volume resistivity of $10^5\Omega$ cm, and the insulating layer of the drum consists of a polyester having a thickness of 12.5 μm and a specific inductive capacity of 3.

The transfer-completed copying material 10 wraps around and is held on the transfer drum 3 thereby to be moved along therewith due to the electrostatic attraction thereof by the application of a positive bias voltage of +800 V to +1000 V thereto from bias power supply 106.

The photoreceptor drum, after the image transfer, is cleared of its surface residual toner by cleaning means 24, and also cleared of its surface residual charge by neutralizer lamp 25, and, after that, is reused.

The copying paper 10, held on transfer drum 3, advances with the revolution of the drum 3, and the momentary position of the paper is read by sensor 26 to thereby start a second exposure operation synchronously with the position. The second exposure is made through green filter $F_G$, and the development is performed by developing means 21M containing a negatively charged magenta developer. The obtained magenta toner image is superposedly transferred onto the yellow image on the copying paper 10, coming with its position held on the transfer drum into the position A. The yellow toner is attracted by the positive bias voltage of the transfer drum, so that the toner is not disturbed nor retransferred to the photoreceptor 1 side.

Further, onto the above toner image is superposedly transferred a cyan toner image obtained in like manner;—the exposure through red filter $F_R$ and the development by developing means 21C containing a cyan developer. The cyan toner imagetransfer-completed copying paper 10 is neutralized by being subjected to a DC corona discharge from copying material charge-neutralizing corona discharger 27, then separated from the drum 3 by separation claw 11 being in its down position, and then sent to heat roller fixing means (not shown), whereby the toner image is fixed. The three color toners transferred onto the copying paper 10 are fused to be mixed in the fixation, thus reproducing a color image by the subtractive color process.

The copying paper-separated transfer drum 3 is neutralized by transfer drum neutralizer 28, and further cleared of its surface residual toner by transfer drum cleaner 29 thereby to be ready for the subsequent copying operation cycle.

When performing monochromatic image copying operation, a single unit of developing means alone is operated, separation claw 11 is kept in its down position, and neutralizer 27 is continuously operated, whereby monochromatic copies can be obtained successively and rapidly.

In addition to thus applying a positive bias voltage to transfer drum 3, a corona discharger may be provided in a position opposite to the transfer drum 3 to subject the drum to a positive charge, which is of the same polarity as that of the toner.

EXAMPLE 4

Figure 12:
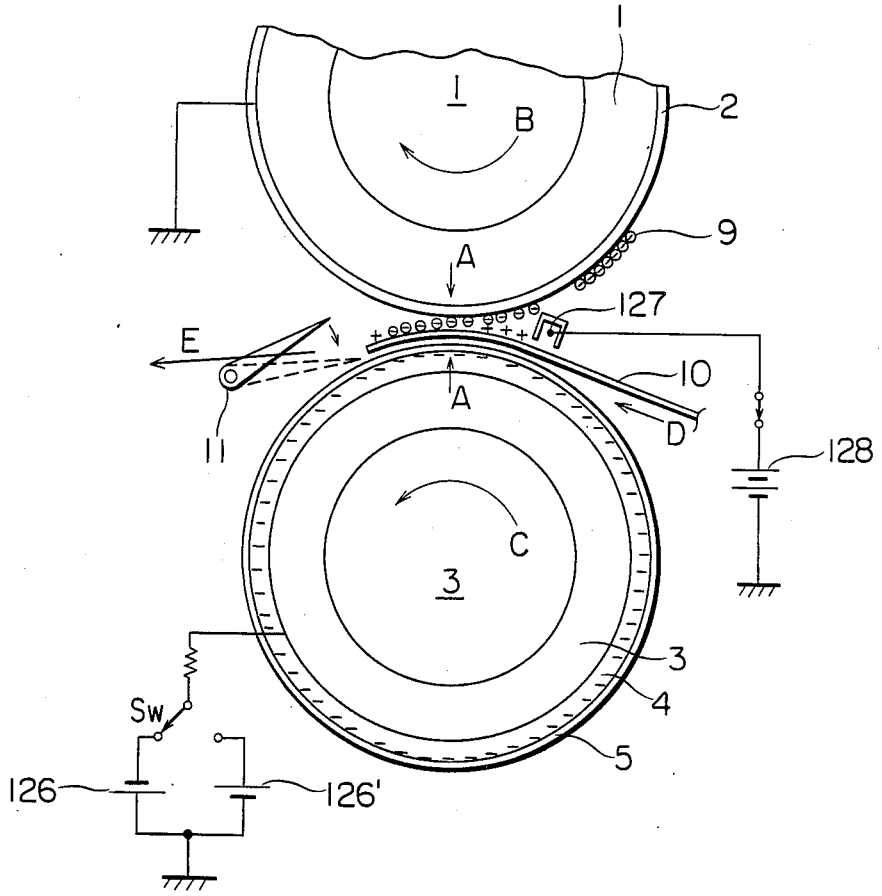

FIG. 12 shows an example of the image transfer device which is so constructed that the surface of a copying material is given a charge of an opposite polarity to that of the charge of the toner, and to the transfer drum is applied a bias voltage of either an opposite polarity to or the same polarity as that of the charge of the toner, the polarity of the bias voltage being changeable, during the course of the transfer process in the device.

That is, this device is intended to accelerate the transfer of the toner to a copying material and at the same time to electrostatically attract and fix the copying material to the surface of the transfer drum through the application of a bias voltage to the drum by timely changing the polarity thereof to be the same (opposite to the polarity of the copying material charged in the initial stage) as or opposite to that of the charge of the toner. The device requires no detention means such as a gripper for fixing the copying material onto the transfer drum and therefore causes no such various problems as those stated previously, thus enabling the doubling troublefree superposed transfer of toners at an improved toner transfer efficiency. The polarity of the charge to be provided to the surface of a copying material, according to the charge of the toner (determined according to the polarity of the electrostatic image on the image carrier), is so settled as to be opposite to the polarity of the charge of the toner used. The suitable voltage to be applied to the copying material charge-providing corona discharger, although it depends on the image carrier, nature of the toner used, etc., is usually in the range of 5 to 8 KV.

To the transfer drum, as stated above, is applied a bias voltage with its polarity timely changed to be the same as or opposite to that of the charge of the toner. Although the voltage and its polarity to be applied depend on the image carrier, nature of the toner used, etc., the preferred bias of the same polarity as that of the charge of the toner is from 100 to 800 V, while the preferred bias of an opposite polarity to that of the charge of the toner is from 200 to 800 V (both voltages are to the ground potential).

The function of this image transfer device will now be explained.

FIG. 12 is a schematic drawing showing the image transfer device of this invention, wherein 1 is an image carrier drum comprised of conductive base 1 and photoconductive photosensitive layer 2, and 2 is an image transfer drum comprised of conductive base 3, conductive elastic layer 4 and insulating layer 5. The figure shows the case where a selenium-type or amorphous silicon-type positive electrostatic image-forming photosensitive layer is used.

To transfer drum 3 is applied a negative or positive bias voltage from bias power supply 126 or 126', respectively, the changeover to either of which power supplies is made by switching circuit SW.

Image carrier drum 1 and transfer drum 3 are pressedly contacted at the transfer position A with each other, and rotate in the directions of the arrows B and C, respectively, at the same circumferential speed during their operation (In the figure both drums are drawn spacing apart for the convenience of showing the transfer condition in the pattern form.). At the time of starting the device, to the transfer drum is applied a negative bias voltage.

The electrostatic image formed on image carrier drum 1 is developed by a developing means (not shown) containing a negatively charged toner to thereby form a toner image. 9 is the toner that is forming a toner image.

Figure 13:
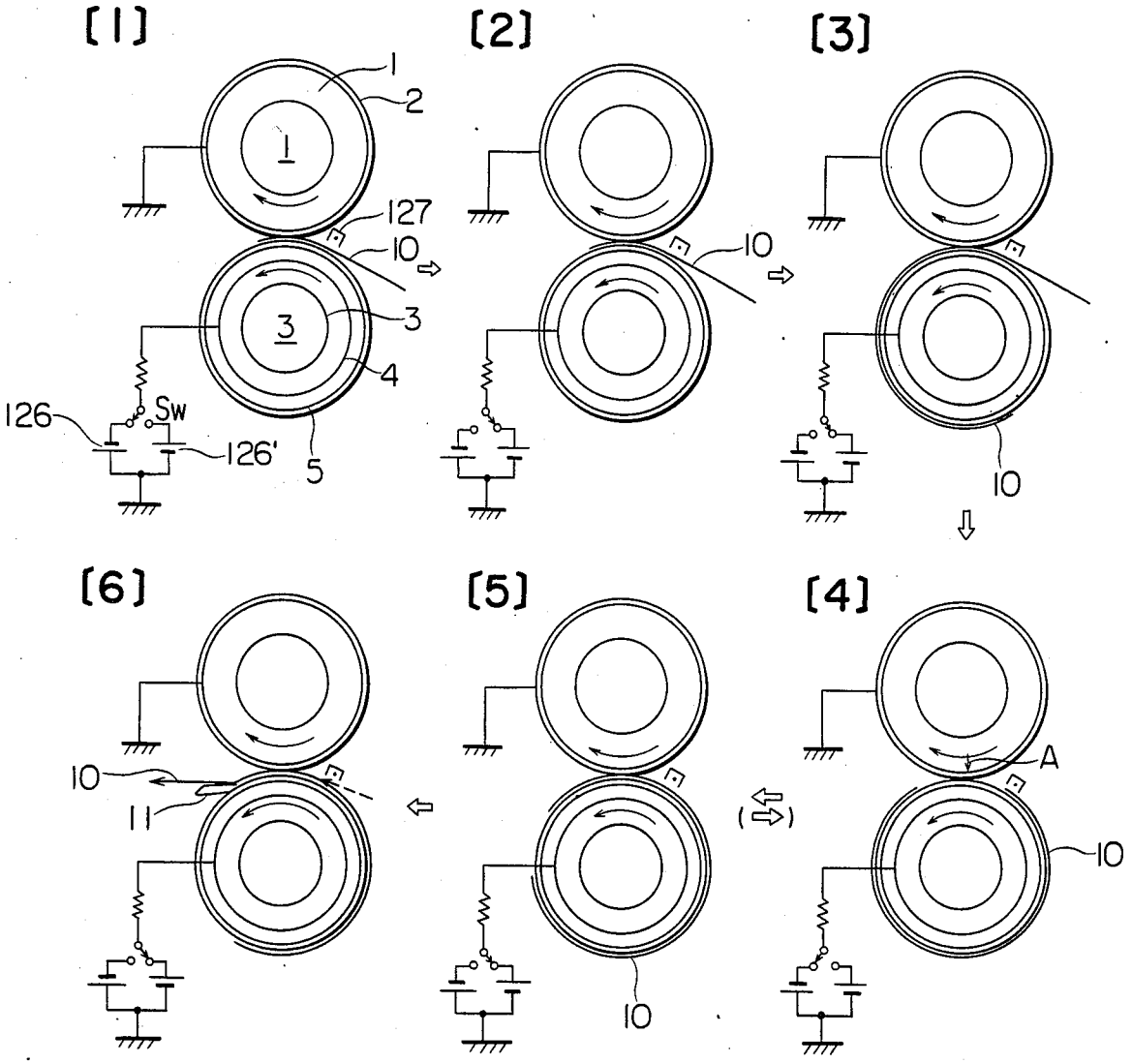

The copying material 10 (its length is shorter than the circumference of the copying material-holding drum 3), which advances in the direction of arrow D by feed means (not shown), is given from the obverse side thereof a positive charge, opposite to the polarity of the toner, by the copying material charge-providing corona discharger 127 connected to power supply 128, and comes into the transfer position at which image carrier drum 1 and copying material-holding drum 3 are in contact with each other. The negatively charged toner particles 9 are attracted to the copying material 10 side by the positive charge on the surface of the copying material, thus completing the transfer of a first toner image. When getting out of the contact portion between both drums, the leading end of copying material 10 undergoes the electrostatic attractions from both drums, but the positively charged copying material 10 is more strongly attracted by the negative bias voltage-applied transfer drum 3 thereby to be fixed onto the surface thereof (FIG. 13-[i]). The change of the polarity of the bias voltage of the transfer drum to positive polarity is made at the point of time when the leading end of the copying material 10 on transfer drum 3 advances by several or 10 mm (the condition is shown in FIG. 13-[2]). If the bias voltage applied to transfer drum 3 is negative, it is very effective in attracting the copying material 10 to transfer drum 3, but because toner 9 is negatively charged, the transfer and attraction of the toner to the copying material 10 is weakened. Accordingly, in this instance, by changing the bias to be positive, the toner is strongly attracted to the transfer drum 3 side, thus improving the toner transfer efficiency and transferred image quality. The change of the bias polarity, on the contrary, weakens the attraction of the copying material 10 to the transfer drum 3 at the transfer position. However, for the holding of the copying material 10 in the transfer drum 3 it is most important that the leading end of the copying material 10 is attracted to be fixed to the transfer drum 3 when getting in and out of the transfer position A between image carrier drum 1 and transfer drum 3. If the about 10 mm portion of the leading end of copying material 10 is securely retained on the transfer drum and once passes through the position A, even though the attraction of the following part of the copying material to the transfer drum at the position A is weakened, the copying material's adherence to the transfer drum continues, and thus the copying material 10 by no means slips out of place or is dislocated, and, as it is, wraps around the transfer drum 3 and is securely held thereon (FIG. 13[3]). The transfer drum 3 makes one revolution after completion of the transfer shown in FIG. 12, and when the leading end of copying material 10 comes into the transfer position for the purpose of the transfer of a second toner image, the bias voltage's polarity is again changed to negative polarity to strengthen the attraction of the copying material to the transfer drum at the transfer position to thereby prevent the copying material from slipping out of place (FIG. 13[4]), and once the leading end of copying material 10 passes through the transfer position A, then the bias voltage's polarity is returned to positive polarity to continue the transfer (FIG. 13[5]). After repeating at need the processes of FIG. 13[4]and [5], copying material separation means such as separation claw 11 is activated to separate the copying material 10 from the transfer drum 3 (FIG. 13[6]) to send the copying material to a fixing section (not shown) to thereby obtain a multicolor copy image.

In addition, in order to obtain monochromatic image copies, if the device is settled in the mode of FIG. 13[6]from the beginning, the copying material comes into the transfer position through the path indicated with the broken line in the figure, and the transfer-completed copying material 10 is at once separated to be sent to the fixation section, so that copies can be obtained rapidly and successively.

As will be described hereinafter, the image transfer device of this invention, due to the construction thereof, has the advantage that the device is suitable for a copying apparatus capable of forming copy images on both sides of a same copying material; -the so-called both-side copying apparatus.

Figure 14:
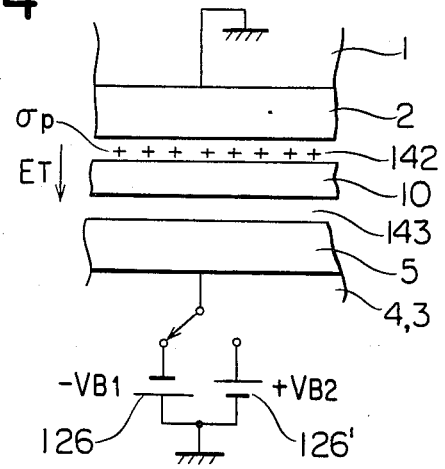

Reference is now made to FIG. 14 for explaining the requirements for satisfactorily performing the image transfer and adequately holding a copying paper on the transfer drum.

FIG. 14 is a schematic representation of the cross-sectional view of the contact portion as the transfer position in FIG. 12, wherein if the specific inductive capacity of photosensitive layer 2 of photoreceptor 1 is expressed as $\epsilon m$, the thickness thereof as dm, the width of gap 142 as da, the thickness of a copying paper as dp, the specific inductive capacity of the paper as $\epsilon p$, electric charge as $\sigma p$, the width of gap 143 as db, the specific inductive capacity in insulating layer 5 of transfer drum 3 as $\epsilon d$, the thickness of the layer as da, and bias voltages as $-VB_1$ (only the leading end of the copying paper) and $+VB_2$, then the transfer electric field ET (the vector direction is shown in the figure) is expressed by the formula:

$$E_T = \frac{-\left(\frac{d_p}{\epsilon_p} + d_b + \frac{d_d}{\epsilon_d}\right)\sigma_p \begin{smallmatrix}+\epsilon_o V_{B1}\\-\epsilon_o V_{B2}\end{smallmatrix}}{\epsilon_o\left(\frac{d_m}{\epsilon_m} + d_a + \frac{d_p}{\epsilon_p} + d_b + \frac{d_d}{\epsilon_d}\right)}$$

When the value of ET is negative, the transfer of a negatively charged toner is possible.

The electric field $E_1$, which attracts the copying paper to the photoreceptor side, is expressed by the formula:

$$E_1 = \frac{-\left(\frac{d_p}{\epsilon_p} + d_b + \frac{d_d}{\epsilon_d}\right)\sigma_p \begin{smallmatrix}+\epsilon_o V_{B1}\\-\epsilon_o V_{B2}\end{smallmatrix}}{\epsilon_o\left(\frac{d_m}{\epsilon_m} + d_a + \frac{d_p}{\epsilon_p} + d_b + \frac{d_d}{\epsilon_d}\right)}$$

When this value is negative, the copying paper is attracted to the photoreceptor side, and its force $F_1$ is:

$$F_1 = \frac{\left(-\left(\frac{d_p}{\epsilon_p} + d_b + \frac{d_d}{\epsilon_d}\right)\sigma_p \begin{smallmatrix}+\epsilon_o V_{B1}\\-\epsilon_o V_{B2}\end{smallmatrix}\right)^2}{2\epsilon_o\left(\frac{d_m}{\epsilon_m} + d_a + \frac{d_p}{\epsilon_p} + d_p + \frac{d_d}{\epsilon_d}\right)^2}$$

On the other hand, the electric field $E_2$, which attracts the copying paper to the transfer drum side, is expressed by the formula:

$$E_2 = \frac{\left(\frac{d_m}{\epsilon_m} + d_a\right)\sigma_p \begin{smallmatrix}+\epsilon_o V_{B1}\\-\epsilon_o V_{B2}\end{smallmatrix}}{\epsilon_o\epsilon_p\left(\frac{d_m}{\epsilon_m} + d_a + \frac{d_p}{\epsilon_p} + d_b + \frac{d_d}{\epsilon_d}\right)}$$

When this value is positive, the copying paper is attracted to the photoreceptor side, and its force $F_2$ is:

$$F_2 = \frac{\left(\left(\frac{d_m}{\epsilon_m} + d_a\right)\sigma_p \begin{smallmatrix}+\epsilon_o V_{B1}\\-\epsilon_o V_{B2}\end{smallmatrix}\right)^2}{2\epsilon_o\epsilon_p\left(\frac{d_m}{\epsilon_m} + d_a + \frac{d_p}{\epsilon_p} + d_p + \frac{d_d}{\epsilon_d}\right)^2}$$

In order that the transfer is well performed, $|ET|$ needs to be not less than 100 KV/cm, and preferably not less than 350 KV/cm.

And in order that the copying paper wraps around the transfer drum, at least when the leading end of the copying material, i.e., the bias voltage, is $-VB_2$, it is necessary to establish the following relation:

$$|F_1| < |F_2| \quad (1)$$

By substituting the values of $F_1$ and $F_2$ for the above (1), the conditions of the respective parameters can be obtained, and by determining part of the parameters, desirable other parameters can be obtained.

As will be described hereinafter, in a device by which a satisfactory transfer was actually performed, it was confirmed that the above requirements were satisfied.

The following is an example of the application of this image transfer device to a color copier based on the three-color separation process.

Figure 15:
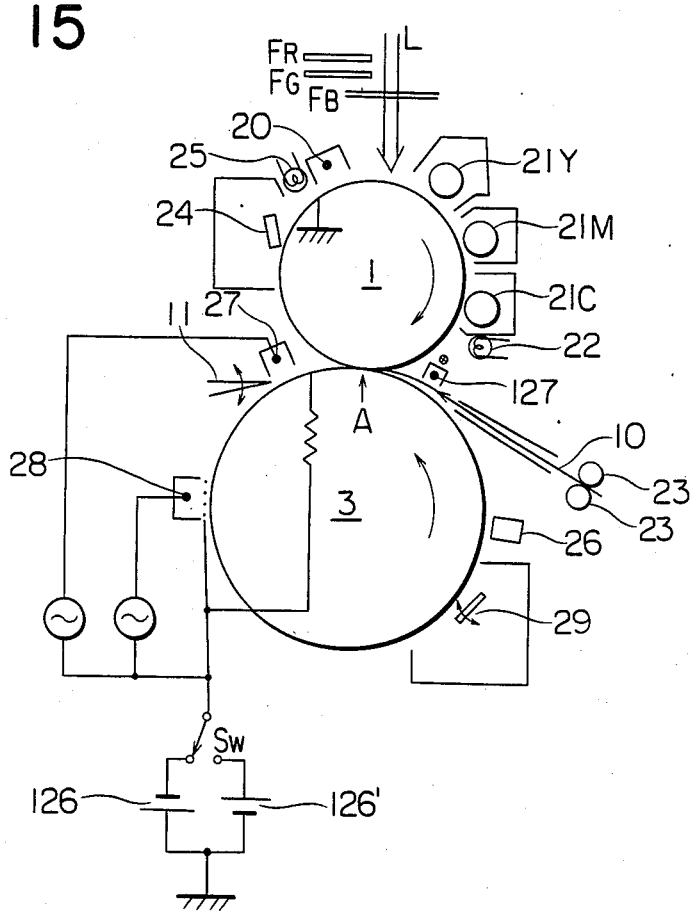

FIG. 15 is a schematic illustration of the image forming and image transfer sections of a color copying apparatus which uses the image transfer device of this invention. Also in this figure, the members having the same functions as those defined in FIG. 4 are indicated with the same numbers. In the figure, arrow L is the path of an image exposure light that has scanned an original image coming from an optical system (not shown). The scanning is repeated three times, and each time, one after the others, filters $F_R$ (red), $F_G$ (green) and $F_B$ (blue), each is inserted into the optical path L to perform color separation exposures. The figure shows that the blue filter $F_B$ is in the optical path. The development was made by use of a two-component developer.

1 is a photoreceptor drum constructed in the same way as in the image carrier drum of FIG. 1, and uses a Se-Te photoreceptor whose specific inductive capacity $\epsilon m=6$ and whose thickness $dm=60$ μm. The drum rotates in the direction of the arrow, then is positively charged overall by corona discharger 20, and then exposed imagewise to the light coming through the optical path L. Firstly, the blue filter is inserted in the optical path to make an exposure to form an electrostatic image on photoreceptor drum 1, and then developed by developing means 21Y containing a negatively charged yellow developer to thereby form an yellow toner image. The yellow toner image-carrying photoreceptor drum is neutralized, prior to image transfer, by neutralizer lamp 22, and then advances to the transfer position A.

On the other hand, the copying material 10, fed by paper feed rollers 23, is given from the obverse side thereof a positive charge of $1\times10^{-4}$ C/m$^2$ by corona discharger 127, and sent to the transfer position A to be put in between photoreceptor drum and transfer drum 3 to thereby start the transfer of the yellow toner image. In the meantime, the transfer drum 3 is given a negative bias voltage of $-500$ V by bias power supply 126 to strongly attract the copying paper 10, but after the about 10 mm part of the leading end of the copying material passes through the position A, the bias is changed to a positive bias $+VB_2$ of $+500$ V from power supply 6' by the operation of SW to thereby continue the transfer of the yellow toner image.

The transfer drum 3 is of the same construction as that of FIG. 12, but in this figure, details are omitted. The diameter of the transfer drum 3 is 150 mm, and the conductive elastic layer thereof consists of a conductive rubber having a thickness of 2 mm, a hardness of 50°, and a volume resistivity of $10^5\Omega$ cm. The insulating layer of the drum is comprised of a polyester having a thickness $dd=25$ μm and a specific inductive capacity $\epsilon d=3$.

The copying paper used herein has a specific inductive capacity $\epsilon p=2$ and a thickness $dp=100$ μm. Gap da between the photoreceptor and the copying paper is 1 μm, and gap db between the transfer drum and the copying paper also is 1 μm.

The photoreceptor drum, after the image transfer, is cleared of its surface residual toner by cleaning means 24, and also cleared of its surface residual charge by neutralizer lamp 25, and then reused.

The copying paper 10, held on transfer drum 3, advances with the revolution of the drum, and its momentary position is read by sensor 26 to thereby start the second exposure operation synchronously with the position. The second exposure is made using green filter $F_G$, and the development is made by developing means 21M containing a negatively charged magenta developer. The obtained magenta toner image is then superposedly transferred onto the yellow toner image on the copying paper 10, which is held on the transfer drum and coming into the position A. The polarity of the bias voltage applied to transfer drum 3 is changed to negative polarity before the copying paper 10 reaches the position A, and the paper is strongly attracted to the transfer drum 3, so that the copying paper does not at all slip out of place by pressure caused when the paper comes into the contact position, and therefore the transfer of the magenta toner image to the correct position can be carried out. After the about 10 mm part of the leading end of the copying paper passes through the position A, the polarity of the bias is again returned to positive polarity. The previously transferred yellow toner image, because of being strongly attracted to the copying paper side not only by the positive charge of the copying paper itself but also by the positive bias applied to transfer drum 3, is not disturbed at all when the magenta toner image is superposedly transferred thereonto nor retransferred to the photoreceptor 1 side.

Further, onto the above-obtained toner image is superposedly transferred a cyan toner image obtained through similar processes;-the exposure through red filter $F_R$ and the development by developing means 21C containing a cyan developer. The cyan toner image transfer-completed copying paper 10 is neutralized by being subjected to DC corona discharge from copying material-neutralizing corona discharger 27, then separated from the transfer drum by separation claw 11 being in its down position, and then sent to heat roller fixation section (not shown), whereby the toner image is fixed. The three color toners transferred onto the copying paper 10 are fusedly mixed to thereby reproduce a color image by the subtractive color process.

The copying paper-sepafated transfer drum 3 is neutralized by transfer drum neutralizer 28, and further cleared of its surface residual toner by transfer drum cleaner 29 thereby to be ready for the subsequent copying operation cycle.

When making monochromatic image copies by this device, a single unit of developing means alone is operated, separation claw 11 is kept in its down position, and neutralizer 27 is continuously operated, whereby copies can be succesively and rapidly obtained.

The respective parameters in this example are listed as follows:

Photoreceptor: Se/Te $\epsilon m=6$, $dm=60\ \mu m$
da, db: $1\ \mu m$
Paper: $\epsilon p=2$, $dp=100\ \mu m$
p: $1\times10^{-4}\ C/m^2$
$VB_1$: $-500$ V, $+VB_2$: $+500$ V
Insulating layer: Polyester $d=3$, $da=25\ \mu m$ The values of $E_T$, $E_1$, $E_2$, $F_1$ and $F_2$ calculated using these parameters are as follows, and it is confirmed that they satisfy the requirements for holding the copying paper on the transfer drum.

| When the bias is $-VB_1$ | When the bias is $-VB_2$ |
|---|---|
| $E_T = -2.2 \times 10^6$ V/m | $-1.7 \times 10^7$ V/m |
| $E_1 = -2.2 \times 10^6$ V/m | $-1.7 \times 10^7$ V/m |
| $E_2 = 4.5 \times 10^6$ V/m | to the photoreceptor side |
| $F_1 = 2.1 \times 10$ N/m$^2$ | $1.3 \times 10^2$ N/m$^2$ |

-continued

| When the bias is $-VB_1$ | When the bias is $-VB_2$ |
|---|---|
| $F_2 = 1.8 \times 10^2$ N/m$^2$ | to the photoreceptor side |

Figure 16:
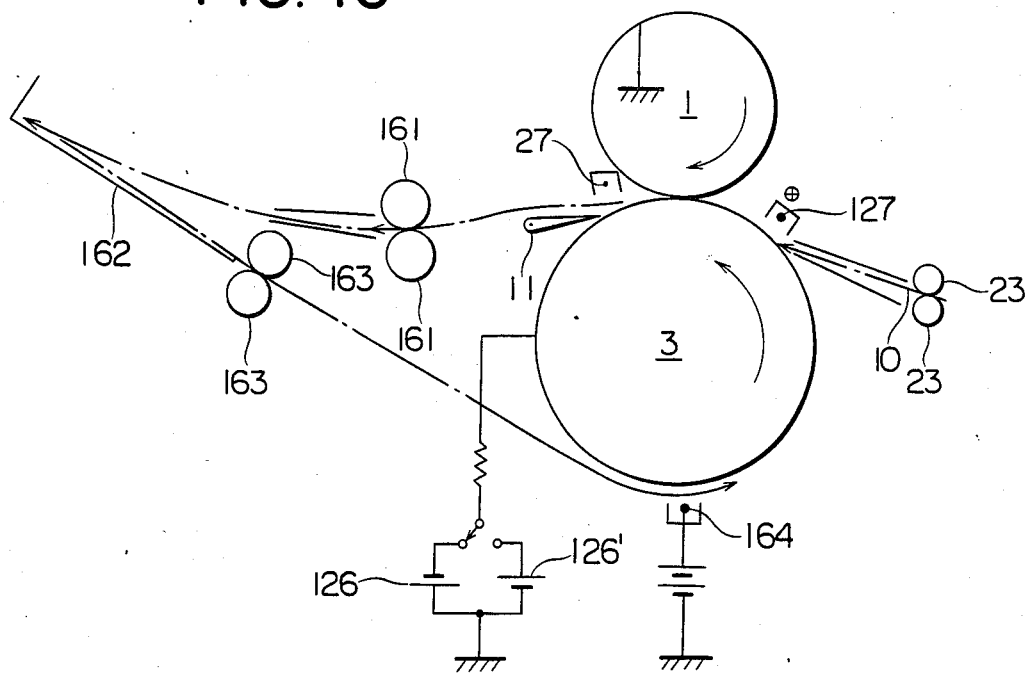
FIG. 16 is a schematic illustration of one in which a both-side copying function is added to the color copying apparatus of FIG. 15.

FIG. 16 shows an example of the application of a bothside copying function to the color copying apparatus of FIG. 4, and details omitted from FIG. 16 are the same as in FIG. 15.

Copying material 10 is fed in the same way as in FIG. 4, positively charged by corona discharger 127, and held on the negative bias voltage-applied transfer drum, and onto the copying material are transferred yellow, magenta and cyan toners through the same processes as those in the copying apparatus of FIG. 2. The cyan toner image transfer-completed copying paper 10 advances through the path indicated with a long and short dash line to be neutralized by copying material-neutralizing corona discharger 27, separated from transfer drum 3 by separation claw 11, and sent to fixation means 161, whereby a color image is completed on the copying paper, which is then ejected onto ejected copy-receiving tray 162. The ejected copying material is drawn with its trailing end forward into the copying apparatus and fed so that its first image-formed surface is brought into contact with the transfer drum 3. The copying paper, which has reached the transfer drum 3, is provided on its second surface with a positive charge by corona discharger 164, and thus is attracted and fixed to the negative bias voltage-applied transfer drum to thereby advance with the revolution of the drum. After that, in the same way as in the case of the first-side image, yellow, magenta and cyan toner images are sequentially transferred onto the second side of the paper, and the paper is separated from the drum and then fixed by fixation means 161, and thus the both-side color image-having copy is ejected onto ejected copy-receiving tray 162.

In the above example, the polarity of the bias is changed, but similar effects can be obtained also by a device which applies a bias of the same polarity as that of the charge of the toner used. In addition, the fixing of the copying paper onto the transfer drum and the superposed image transfer as in the device of FIG. 12 can be carried out also by a device which is so constructed that in place of the bias-applying means of the device of FIG. 1 a charge-providing means located opposite to the surface of the transfer drum is arranged to provide a charge of the same polarity as that of the charge of the toner to the surface of the transfer drum, while the copying paper is given from the obverse side thereof a charge of an opposite polarity to that of the charge of the toner in the same way as in FIG. 12.

In this instance, the copying material is positioned on the transfer drum which is in advance provided with a charge of the same polarity as that of the charge of the toner, and further a charge of an opposite polarity is provided to the copying material from the obverse side thereof to thereby electrostatically attract and fix the copying material to the transfer drum, and then toner image transfer is performed. The polarity of the charge to be provided should be opposite to that of the toner for the copying material and the same as that of the toner for the transfer drum according to the polarity of the charge of the toner (determined according to the polarity of an electrostatic image formed on the image carrier) to be transferred.

In the case of this construction, the applying voltage to the discharger, although different according to the image carrier, nature of the toner used, e.c., is usually preferably from 5 to 8 KV (of an opposite polarity to that of the toner) for the copying material-charging corona discharger. The transfer drum is desirable to be charged so that its surface potential is 100 to 300 V (of the same polarity as that of the toner), and for this purpose a voltage of 4 to 6 KV (of the same polarity as that of the toner) is desirable to be applied to the transfer drum-charging corona discharger. The copying material given a charge of an opposite polarity to that of the charge of the toner is strongly attracted and fixed to and by the transfer drum having a charge of the same polarity as that of the toner, i.e., of an opposite polarity to that of the copying material. Further, because an electrostatic attraction arises also between the toner and the copying material, the transfer of the toner to the copying material is satisfactorily carried out.

EXAMPLE 5

Figure 17:
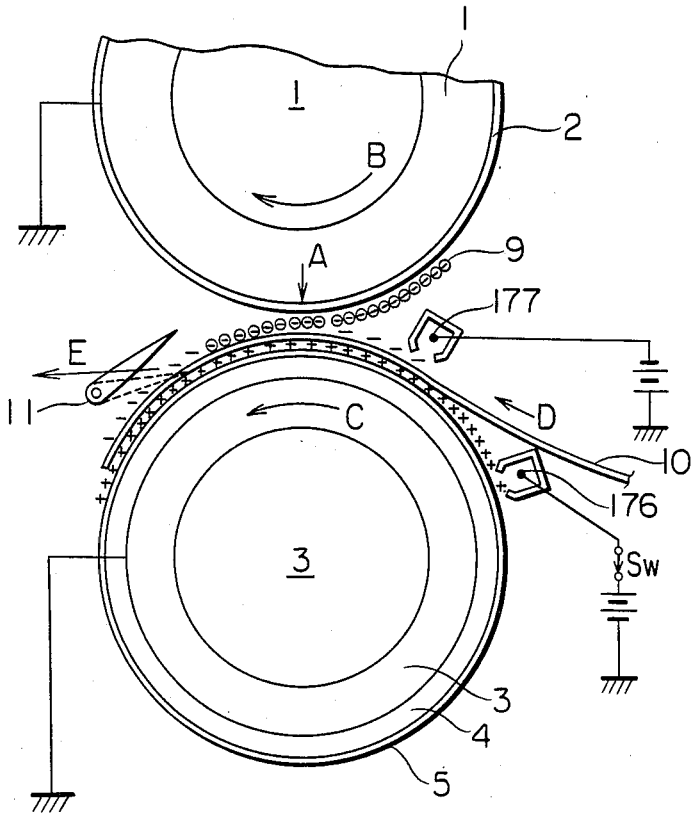

FIG. 17 shows an example of the image transfer device which comprises a means for providing a charge of the same polarity as that of the charge of the toner to the obverse of the copying material and a means for providing a charge of an opposite polarity to that of the charge of the toner to the surface of the transfer drum.

This device is such that a copying material is positioned on the transfer drum which is in advance given a charge of an opposite polarity to that of the charge of the toner, and further, a charge of the same polarity as that of the charge of the toner is given to the obverse of the copying material to thereby electrostatically attract and fix the copying paper to the transfer drum, and then toner image transfer is performed.

In this instance, because the copying material is given a charge of the same polarity as that of the toner, a repulsive force arises between the toner and the copying material, but since the transfer drum is given a high opposite-polarity electrostatic charge to that of the toner, if the amount of the charge to the copying material is settled low, then the electrostatic field brought about by the charge of the transfer drum overcomes the charge of the copying material to thus attract the toner along with the copying material to the transfer drum side, whereby the transfer and retention of the toner can be satisfactoriy carried out.

Also, since the charges of both toner and copying material are of opposite polarity to that of the charge of the transfer drum, the attraction of the copying material to the transfer drum becomes very strong.

The function of this image transfer device will now be explained. FIG. 17 is a schematic drawing showing the image transfer device of this invention, wherein 1 is an image carrier drum comprised of conductive base 1 and photoconductive photosensitive layer 2, and 3 is an image transfer drum comprised of conductive base 3, conductive elastic layer 4 and insulating layer 5. The figure shows the case where a selenium-type or amorphous silicon-type positive electrostatic image-forming photosensitive layer is used.

Transfer drum 3 is grounded, and the surface thereof is positively charged by transfer drum-charging corona discharger 176. 177 is a copying material-charging corona discharger located opposite to the transfer drum, to which is applied a negative voltage.

Image carrier drum 1 and image transfer drum 3 are pressedly contacted at the transfer position A with each other, and rotate in the direction of arrows B and C, respectively, during their operation (in the figure, both drums are drawn spacing apart for the convenience of showing the transfer condition in the pattern form).

The electrostatic image formed on image carrier drum 1 is developed by developing means (not shown) containing a negatively charged toner. 9 is the toner that is forming a toner image.

The copying material 10 (its length is shorter than the circumference of the copying material-holding drum 3), which advances in the direction of arrow D, is given a charge of the same polarity as that of the charge of the toner, and comes into the transfer position where image carrier drum 1 and image transfer drum 3 are in contact with each other. The negatively charged toner particles are attracted by the positive charge on the surface of the transfer drum and transferred to the copying material side to thereby complete the transfer of a first toner image. When getting out of the contact portion between both drums, the copying material undergoes the electrostatic attractions from both drums, but the negatively charged copying material 10 is more strongly attracted to and by the surface of transfer drum 3, which is in advance positively charged by trancefer drum-charging corona discharger 6, and wraps around the surface of the transfer drum and is fixed thereto. The copying material, because of being contacted overall with the transfer drum and strongly fixed thereto, by no means slips out of place in the following process. The copying material 10, which wraps around the transfer drum 3, advances again into the transfer position A with the revolution of the drum 3, whereby a second toner image is transferred. The corona discharger 6, at the point of time when the transfer drum completes one revolution without undergoing a discharge, activates switching circuit SW to stop the operation of the drum. After that, the transfer through the same process is repeated a necessary number of times, whereby a multicolor image is completed on the copying material 10. In the meantime, the positive charge given to the surface of the transfer drum remains unattenuated because the surface of the transfer drum is insulation, so that the transfer of the toner is well carried out.

After completion of the transfer, the copying material is separated from the copying material-holding drum by separation means such as a separation claw thereby to be sent to the fixation process. In the figure, 11 is a separation claw, and by rotatively moving the claw down to the position indicated with the broken line, the copying material is separated from the drum 3 and advances in the direction of arrow E. In addition, when making monochromatic copies, if the device is settled in this mode from the beginning, the transfer-completed copying material is at once ejected in the direction of arrow E, whereby copies can be obtained rapidly and successively.

The following is an example of the application of this image transfer device to a color copying apparatus based on the three-color separation process.

Figure 18:
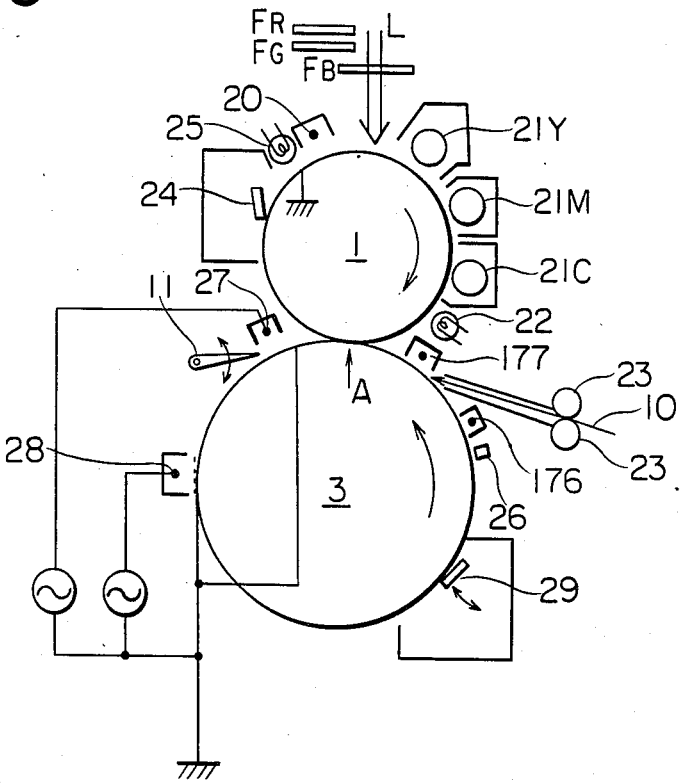

FIG. 18 is a schematic illustration showing the image-forming and image transfer sections of a color copying apparatus which uses the image transfer device of this invention. Also in this figure, the members having the same functions as those defined in FIG. 1 are indicated with the same numbers. In the figure, arrow L represents the optical path of an image exposure light that has scanned an original image sent from an optical system (not shown). The scanning is repeated three times, and each time, one after the others, filters $F_R$ (red), $F_G$ (green) and $F_B$ (blue) each is inserted into the optical path L to perform color separation exposures. The figure shows that the blue filter $F_B$ is in the optical path.

1 is a photoreceptor drum which is of the same construction as that of the image carrier drum of FIG. 1 and which uses a selenium-type photoreceptor (in this example, Se-Te photoreceptor having a specific inductive capacity $\epsilon=6$ and a thickness of 60 μm is used). The photoreceptor rotates in the direction of the arrow, is positively charged overall by corona discharger 20, and then exposed imagewise to the light coming through optical path L. Firstly, an exposure is made through the blue filter inserted in the optical path to form an electrostatic image on photoreceptor drum 1, and then the electrostatic image is developed by developing means 21Y containing a negatively charged yellow developer to thereby form an yellow toner image. The yellow toner image-carrying photoreceptor drum, prior to image transfer, is neutralized by neutralizer lamp 22, and then advances to the transfer position A.

On the other hand, the copying paper 10, which is fed through paper feed rollers 23, is electrostatically attracted to and by transfer drum 3, which is in advance positively charged so that its surface potential becomes from +800 V to 1000 V by transfer drum-charging corona discharger 176. Further, the obverse of the copying paper is negatively charged by copying material-charging corona discharger 177 so that the negative charge is $-1\times10^{-8}$ C/cm$^2$. As a result, the copying material 10 is strongly attracted to the transfer drum 3, and advances to the transfer position A to be put in between photoreceptor drum 1 and transfer drum 3, whereby the yellow toner image is transferred. Although the obverse of the copying material is negatively charged, the negatively charged toner is satisfactorily transferred to the copying material due to the strong electrostatic field of the transfer drum.

In addition, the transfer drum 3 has the same construction as that of FIG. 1, but details are omitted in FIG. 18.

The conductive rubber layer of the transfer drum 3 in this example has a thickness of 2 mm, a hardness of 50° and a volume resistivity of $10^5$ Ωcm, and the insulating layer is comprised of a polyester having a thickness of 12.5 μm and a specific inductive capacity of 3.

The transfer-completed copying material 10 is caused by the electrostatic attraction of the positively charged transfer drum 3 to wrap therearound and is moved with its position fixed thereto.

The photoreceptor drum, after the transfer, is cleared of its surface residual toner by cleaning means 24, and further cleared of its surface residual charge by neutralizer lamp 25, and then reused.

The copying material 10, carried by transfer drum 3, advances with the revolution of the drum 3, and the momentary position of the copying material is read by sensor 26, whereby the second exposure is started synchronously with the position. Sensor 26, at the point of time when detecting the leading end of the copying material, stops the application of the voltage to the copying material-charging corona discharger, and the negative discharge therefrom prevents the negative charge-having toner image transferred onto the surface of the copying material from being impaired.

The second exposure is made through green filter FG, and the exposed copying material is developed by developing means 21M containing a negatively charged magenta developer. The obtained magenta toner image is superposedly transferred onto the yellow image on the copying material 10, which, with its position fixed to the transfer drum, comes into the position A. The yellow image, because of being firmly attracted to the transfer drum by the positive charge thereof, is not disturbed at all nor retransferred to the photoreceptor drum 1 side.

Further, onto the above-obtained toner image is superposedly transferred a cyan toner image obtained by similar processes; –the exposure through red filter FR and the development by developing means 21C containing a cyan developer. The cyan toner image transfer-completed copying paper 10 is neutralized by undergoing an AC corona discharge from copy paper neutralizing corona discharger 27, and separated from the drum 3 by putting separation claw 11 down to the drum 3 side, and then sent to heat roller fixation means (not shown) thereby to be fixed. The three color toners transferred onto the copying paper 10 are fusedly mixed in the fixation, whereby a color image by the subtractive color process can be obtained.

The copying paper-separated transfer drum 3 is neutralized by transfer drum neutralizer 28, and further cleared of its surface residual toner by transfer drum cleaner 29 thereby to be ready for the following copying operation cycle.

When making monochromatic image copies, if a single unit of developing means alone is operated, separation claw 11 is kept in its down position, and neutralizer 27 is continuously operated, whereby copies can be obtained successively and rapidly.

Figure 19:
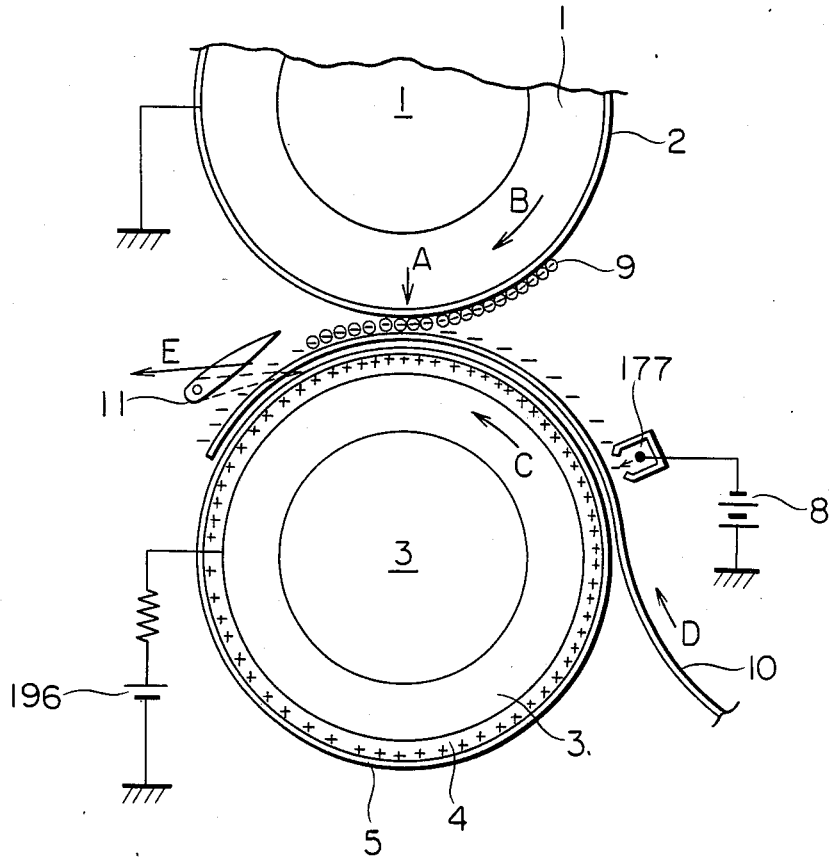

In addition, almost the same effect can be obtained also by the device of FIG. 19, which is so constructed that a means for applying a bias voltage of the same polarity as that of the charge of the toner to the transfer drum is arranged in place of the transfer drum-charging means of the device of FIG. 17. In FIG. 19, 196 is a bias power supply, and the other members having the same functions as those defined in FIG. 17 are numbered in the same way. In this device, the copying material having a charge of the same polarity as that of the charge of the toner is strongly attracted to and by the transfer drum to which is applied a bias voltage of an opposite polarity to that of the toner. Although a repulsive force due to the same-polarity charges is produced between the copying material and the toner as in the case of the device of FIG. 17, the high opposite-polarity bias voltage applied to the transfer drum attracts also the toner to the copying paper, and thus the image transfer is performed.

The various embodiments of the image transfer device of this invention have been described above, and in any of the cases a copying material can be fixed onto the transfer drum without providing any detention means on the drum. Consequently, the device of this invention has many advantages that the copying material-holding drum, since it has no detention means, can be used in any arbitrary position; the transfer drum and image carrier drum can always be kept in pressed contact with each other, thus requiring no mechanism of releasing the pressed contact for avoiding the striking of detention means against the image carrier drum or of registering; cleaning of the transfer drum can be easily performed; and the like. Accordingly, the use of the device of this invention enables to obtain a multicolor electrostatic recording apparatus of a simple structure capable of insuring the multicolor image transfer with no doubling trouble.

We claim:

1. An image transfer device which transfers a charged toner carried on an image carrier onto a copying material, said image transfer device comprising:

a transfer drum which comprises a conductive base and an insulating surface, said transfer drum being arranged opposite to said image carrier;

a first charge-providing means for providing an electric charge to said copying material in advance of said copying material arriving at said insulating surface of said transfer drum; and a second charge-providing means for providing a specified charge on the surface of said transfer drum in advance of said copying material arriving at said insulating surface of said transfer drum for attracting said copying material to said surface of said transfer drum and to maintain said attraction by said charges during a copying operation.

2. The image transfer device of claim 1, wherein said transfer drum comprises a conductive elastic layer provided on said conductive base, and an insulating layer provided on the surface of said conductive elastic layer, the outer surface of said insulating layer comprising said insulating surface of said drum.

3. The image transfer device of claim 1, wherein:

said first charge-providing means comprises means for providing a charge of the opposite polarity to that of said charged toner; and said second charge-providing means comprises means for providing a charge of the same polarity as that of said charged toner.

4. The image transfer device of claim 3, wherein said first charge-providing means includes means for providing said charge of said opposite polarity to said copying material from the reverse side of said copying material which faces said transfer drum.

5. The image transfer device of claim 1, wherein:

said first charge-providing means comprises means for providing a charge of the same polarity as that of said charged toner; and said second charge-providing means comprises means for providing a charge of the opposite polarity to that of said charged toner.

6. The image transfer device of claim 5, wherein said first charge-providing means includes means for providing said charge of said same polarity to said copying material from the reverse side of said copying material which faces said transfer drum.

7. The image transfer device of claim 1, wherein:

said conductive base of said transfer drum is grounded; and said second charge-providing means comprises means for providing a charge of an opposite polarity to that of the charge of said charged toner to the surface of said transfer drum.

8. The image transfer device of claim 1, wherein:

said conductive base of said transfer drum is grounded; and said second charge-providing means comprises means for providing a charge of the same polarity as that of the charge of said charged toner to the surface of said transfer drum.

9. The image transfer device of claim 1, wherein said electric charge is provided to said copying material from a side thereof facing said transfer drum.

10. An image transfer device which transfers a charged toner carried on an image carrier onto a copying material, said image transfer device comprising:

a transfer drum which comprises a conductive base and an insulating surface, said transfer drum being arranged opposite to said image carrier;

a first charge-providing means for providing an electric charge to said copying material in advance of said copying material arriving at said insulating surface of said transfer drum; and a bias voltage applying-means for applying a bias voltage to said conductive base of said transfer drum for attracting said copying material to said surface of said transfer drum and to maintain said attraction of said copying material to said surface of said transfer drum during a copying operation.

11. The image transfer device of claim 10, wherein said transfer drum comprises a conductive elastic layer provided on said conductive base, and an insulating layer provided on the surface of said conductive elastic layer, the outer surface of said insulating layer comprising said insulating surface of said drum.

12. The image transfer device of claim 10, wherein:

said first charge-providing means comprises means for providing a charge of the opposite polarity to that of said charged toner; and said bias voltage-applying means comprises means for applying a bias voltage of the same polarity as that of said charged toner.

13. The image transfer device of claim 12, wherein said first charge-providing means includes means for providing said charge of said opposite polarity to said copying material from the reverse side of said copying material which faces said transfer drum.

14. The image transfer device of claim 10, wherein:

said first charge-providing means comprises means for providing a charge of the same polarity as that of said charged toner; and said bias voltage-applying means comprises means applying a bias voltage of the opposite polarity to that of said charged toner.

15. The image transfer device of claim 14, wherein said first charge-providing means includes means for providing said charge of said same polarity to said copying material from the reverse side of said copying material which faces said transfer drum.

16. The image transfer device of claim 10, wherein said bias voltage-applying mean comprises means for applying said bias voltage of an opposite polarity to that of the charge of said charged toner to said conductive base of said transfer drum.

17. The image transfer device of claim 10, wherein said bias voltage-applying means comprises means for applying said bias voltage of the same polarity as that of the charge of said charged toner to said conductive base of said transfer drum.

18. The image transfer device of claim 10, wherein said bias voltage-applying means comprises means for changeably applying said bias voltage, of either the same polarity as or an opposite polarity to that of the charge of said charged toner, to said conductive base of said transfer drum.

* * * * *